US007273060B2

(12) United States Patent
Patel et al.

(10) Patent No.: US 7,273,060 B2
(45) Date of Patent: Sep. 25, 2007

(54) METHODS FOR CHEMICALLY TREATING A SUBSTRATE USING FOAM TECHNOLOGY

(75) Inventors: Bakul P. Patel, Pleasanton, CA (US); Mihaela Cernat, Brentwood, CA (US); Robert J. Small, Dublin, CA (US)

(73) Assignee: EKC Technology, Inc., Hayward, CA (US)

( * ) Notice: Subject to any disclaimer, the term of this patent is extended or adjusted under 35 U.S.C. 154(b) by 25 days.

(21) Appl. No.: 11/450,291

(22) Filed: Jun. 12, 2006

(65) Prior Publication Data

US 2007/0135321 A1 Jun. 14, 2007

Related U.S. Application Data

(63) Continuation of application No. 10/060,109, filed on Jan. 28, 2002, now abandoned.

(51) Int. Cl.

| | |
|---|---|
| ***B08B 3/04*** | (2006.01) |
| ***B08B 3/08*** | (2006.01) |
| ***C11D 7/32*** | (2006.01) |
| ***C11D 7/50*** | (2006.01) |

(52) U.S. Cl. ..... 134/1.3; 134/34; 510/175; 510/176; 510/255; 510/258; 510/264; 510/499; 510/500

(58) Field of Classification Search ..... None
See application file for complete search history.

(56) References Cited

U.S. PATENT DOCUMENTS 3,592,773 A 7/1971 Muller
4,395,479 A 7/1983 Ward et al.
4,401,747 A 8/1983 Ward, Jr. et al.
4,403,029 A 9/1983 Ward, Jr. et al.

(Continued)

FOREIGN PATENT DOCUMENTS

EP 0 662 705 8/2000

(Continued)

OTHER PUBLICATIONS

Intl Search Report Corresponding to: (PCT/US 02/03233), Apr. 17, 2003.

(Continued)

*Primary Examiner*—Gregory R. Del Cotto
(74) *Attorney, Agent, or Firm*—Morgan Lewis & Bockius LLP

(57) ABSTRACT

The present invention relates to methods and compositions for treating a surface of a substrate by foam technology that includes at least one treatment chemical. The invention more particularly relates to the removal of undesired matter from the surface of substrates with small features, where such undesired matter may comprise organic and inorganic compounds such as particles, films from photoresist material, and traces of any other impurities such as metals deposited during planarization or etching. A method according to the present invention for treating a surface of a substrate comprises generating a foam from a liquid composition, wherein the liquid composition comprises a gas; a surfactant; and at least one component selected from the group consisting of a fluoride, a hydroxylamine, an amine and periodic acid; contacting the foam with the surface of a substrate; and, removing the undesired matter from the surface of the substrate.

30 Claims, 9 Drawing Sheets

U.S. PATENT DOCUMENTS

| | | | | |
|---|---|---|---|---|
| 4,428,871 | A | 1/1984 | Ward et al. | |
| 4,508,591 | A | 4/1985 | Bartlett et al. | |
| 4,744,834 | A | 5/1988 | Haq | |
| 4,770,713 | A | 9/1988 | Ward | |
| 4,781,764 | A | 11/1988 | Leenaars | |
| 4,817,652 | A | 4/1989 | Liu et al. | |
| 5,129,955 | A | 7/1992 | Tanaka | |
| 5,181,985 | A | 1/1993 | Lampert et al. | |
| 5,334,332 | A | 8/1994 | Lee | |
| 5,560,857 | A | 10/1996 | Sakon et al. | |
| 5,563,119 | A | 10/1996 | Ward | |
| 5,571,447 | A | 11/1996 | Ward et al. | |
| 5,603,849 | A | 2/1997 | Li | |
| 5,630,904 | A | 5/1997 | Aoyama et al. | |
| 5,645,737 | A | 7/1997 | Robinson et al. | |
| 5,672,577 | A | 9/1997 | Lee | |
| 5,705,089 | A | 1/1998 | Sugihara et al. | |
| 5,709,756 | A | 1/1998 | Ward et al. | |
| 5,792,274 | A | 8/1998 | Tanabe et al. | |
| 5,798,323 | A * | 8/1998 | Honda et al. | 510/176 |
| 5,885,477 | A | 3/1999 | Rasmussen et al. | |
| 5,972,862 | A * | 10/1999 | Torii et al. | 510/175 |
| 5,981,454 | A | 11/1999 | Small | |
| 6,000,411 | A | 12/1999 | Lee | |
| 6,048,406 | A | 4/2000 | Misra et al. | |
| 6,090,217 | A * | 7/2000 | Kittle | 134/11 |
| 6,117,783 | A | 9/2000 | Small et al. | |
| 6,156,661 | A | 12/2000 | Small | |
| 6,232,228 | B1 | 5/2001 | Kwag et al. | |
| 6,235,693 | B1 * | 5/2001 | Cheng et al. | 510/175 |
| 6,248,704 | B1 * | 6/2001 | Small et al. | 510/176 |
| 6,296,715 | B1 | 10/2001 | Kittle | |
| 6,319,885 | B1 * | 11/2001 | Lee et al. | 510/175 |
| 2002/0037820 | A1 * | 3/2002 | Small et al. | 510/175 |

FOREIGN PATENT DOCUMENTS

| | | |
|---|---|---|
| JP | 53056203 | 5/1978 |
| JP | 63-239820 | 10/1988 |
| WO | WO 92/04942 | 4/1992 |
| WO | WO 98/36045 | 8/1998 |
| WO | WO 00/02238 | 1/2000 |
| WO | WO 01/27986 | 4/2001 |
| WO | PCT/US2002/003233 | 3/2004 |

OTHER PUBLICATIONS

Baklanov, et al., "Applicability of HF Solutions for Contact Hole Cleaning on Top of TiSi2," Electrochemical Society Proceedings, vol. 97-35, pp. 602-609 (1998).

Ireland, P.J., "High Aspect Ratio Contracts: A Review of the Current Tungsten Plug Process," Thin Solid Films, 304:1-12 (1997).

Kittle et al., "Photoresist Residue Removal Using Aqueous foam Proof of Concept Experiments," Auguafoam, Inc. and EKC Technology, Inc., http://www.aquafoam.com/removalall.html (accessed Nov. 2, 2001).

Kittle, P., "Foam Wafer Cleaning Experimental Proof of Concept," Aquafoam, Inc., http://www.aquafoam.com/proof-11mb.html (accessed Nov. 2, 2001).

Kujime, et al., "The Cleaning of Particles From Si Water Surface by Fluorine Solution Excited by Megasonic," Proceedings of the 1996 Semi. Pure Water and Chemicals, pp. 245-256 (1996).

Lee, C. and Lee, S., "Effects of Plasma Treatments On The Erosion Of TEOS-PBSG Films by Chemical Etchants," Solid State Electronics, vol. 41(6): 921-923 (1997).

Liehr and Kasi, "HF and UV-Ozone Integrated Wafer Preclean: Chemistry and Effects on Thermal Gate Oxide," Extended Abstracts of the 1991 International Conference on Solid State Devices and Materials, pp. 484-486.

Ohman, L. and Sjöberg, S., "Equilibrium and Structural Studies of Silicon(IV) and Aluminum(III) in Aqueous Solution. Part 9. A Potentiometric Study of Mono- and Poly-nuclear Aluminum(III) Citrates," J. Chem. Soc. Dalton Trans., pp. 2513-2517 (1983).

Ràfols, et al., "Ionic Equilibria in Aqueous Organic Solvent Mixtures: The Equilibria of HF in an Ethanol+Water Mixture Used for Cleaning Up Semiconductors," J. Electroanalytical Chem. 433, pp. 77-83 (1997).

Singer, P., "Wafer Cleaning: Making the Transition to Surface Engineering," Semi. International, pp. 88-92 (Oct. 1995).

Ueno et al., "Cleaning of CHF3 Plasma-Etched SiO2/SiN/Cu Via Structures with Dilute Hydrofluoric Acid Solutions," J. Electrochem. Soc., vol. 144(7):2565-2572 (1997).

* cited by examiner

METHODS FOR CHEMICALLY TREATING A SUBSTRATE USING FOAM TECHNOLOGY

This application is a continuation of application Ser. No. 10/060,109 filed on Jan. 28, 2002, now abandoned the contents of which is incorporated herein by reference thereto.

FIELD OF THE INVENTION

The present invention relates to methods and compositions for chemically treating a surface of a substrate by using foam technology. The invention more particularly relates to the removal of organic and inorganic compounds such as photoresist and post-etch residue from substrate surfaces.

BACKGROUND OF THE INVENTION

A substrate is an underlying solid material used in manufacturing products such as integrated electronic circuitry and microelectromechanical systems (MEMS). MEMS result from a technological advancement that unites silicon-based microelectronics with micromachining technology with the goal of producing complete systems on a single chip.

Integrated circuit and MEMS manufacturing comprise stepwise patterning and layering processes. Examples of such processes include the use of plasma to etch circuit-defining pathways, deposition of metals in the pathways to form circuitry, and application of chemicals and abrasives to etch, strip and/or and polish contact surfaces for high precision manufacturing. The processes begin with a suitable substrate, such as a wafer of crystalline silicon, upon which materials having the requisite electrical characteristics are deposited. Water and various chemicals may then be used to treat the surface of a substrate. The treatment can comprise cleaning, etching, or rinsing the substrate after each manufacturing step to quench reactions and ensure precision in the final product.

The process steps in the manufacture of integrated circuits offer many opportunities for contaminants to enter the structure of the product semiconductor substrate. Physical contamination is undesired matter and can comprise organic and inorganic materials such as particles, films from photoresist material, and traces of any other impurities such as metals deposited during implanting or etching. Semiconductor substrate cleaning may thus be the most frequent step in manufacturing integrated circuits and is becoming more critical as the features of semiconductor substrates get smaller. There are various methods of cleaning semiconductor wafers, and the process of choice must not only satisfy technical requirements, but must also satisfy environmental regulations and be cost effective.

The technical goal of cleaning a semiconductor substrate is to eliminate physical contamination between each process step without affecting the integrity and detail of the substrate provided by previous steps. Contamination of the surface of the substrate with undesired matter can affect the manufacturing process and reduce ultimate product performance. Thus, ways of avoiding contamination are paramount in the manufacture of electronic circuitry, as are ways of efficiently removing undesired matter without introducing further contaminants. Some cleaning methods developed to satisfy these goals have been discussed in the literature, for example, *Int. Conf. On Solid State Devices and Materials*, pp. 484-486 (1991); Kujime, T., et al., *Proc. Of The* 1996 *Semi. Pure Water and Chemicals*, pp.245-256; and, Singer, P. *Semi. International*, p. 88, (October 1995).

Patterning of integrated circuitry involves depositing material directly on a semiconductor substrate or intervening layers, and each patterning step typically involves the following: applying a photoresist to the surface of the substrate; changing the properties of selected areas of the photoresist by exposing those areas to light, X-rays, or particle beams such as electron or ion beams; removing either exposed or unexposed portions of the photoresist to expose portions of the underlying substrate; chemically treating or depositing material on the exposed portions of the substrate; and removing the residue. Each step in the patterning process can introduce a variety of contaminants, such as various residues, and must usually be followed by a cleaning step before proceeding to the next step in the process.

Etching generally refers to the removal of material from the surface of the semiconductor substrate and includes the pattern defining process. Each layer on the substrate is manufactured individually and then polished to obtain a precise match between layers. Currently, "wet etching" is used to etch semiconductor substrates in a chemical bath, whereas "dry etching" is used to define circuit pathways using a plasma. In dry etching, the plasma is used to form the circuit pathways and is commonly used because of the high precision and selectivity afforded by the process. However, the disadvantage to dry etching is the formation of post-etch residue (PER), which is a difficult to remove by-product of the reaction between the plasma, the substrate surface, and other material present such as the photoresist.

Post-etch residue is found around etched pathways and openings and may be comprised of ashed resist, etching gases, and etched substrate materials. Any post-etch residue must be removed to avoid reduced product performance due to interference from impurities in the intricate pathways or the formation of corrosive chemical species within the residue. One means of removing such contaminants is the use of organic solvents, but such solvents have required operating temperatures of as high as 100° C., often followed by a rinse with volatile and highly flammable solvents. Combining high temperatures with an easily ignitable rinse is clearly less than desirable. Although techniques that do not use isopropyl alcohol have been described, see for example, U.S. Pat. No. 5,571,337, they use vapors of other organic compounds.

Another process that utilizes cleaning chemistries is chemical mechanical polishing (CMP). CMP is a planarization process that combines wet etching with an abrasive slurry to remove excess material between layers in the semiconductor manufacturing process and is as crucial to high product performance as metal deposition or lithography. Planarization improves the contact between the wafer, the dielectric insulators, and the metal substrates, but also increases the room for error in other process steps. Given the onward march towards miniaturization, CMP is becoming a more and more critical step in the manufacturing process, but contaminants introduced during CMP must also be effectively removed.

Since the features of semiconductor wafers are now becoming as small as 0.10 microns, and dimensions of 0.07 microns are projected to occur by the year 2005, thorough removal of contaminants, whether present originally or introduced in preceding process steps, is becoming more critical than ever. Ideally, the sizes of particle contaminants should not exceed one tenth of the minimum feature size. Accordingly, cleaning procedures should thus be effective at removing particles as small as about 0.007 to about 0.010 microns. On these dimensions, the laws of physics produce unexpected results that are a function of the diminishing importance of mass (See e.g., Brown, D., "Surface Tension Rules the Subminiature World of MEMS," available at http://www.engineer.ucla.edu/stories/mems.htm). In practice, in the submicron world, effects attributable to the inertia of particles are dwarfed by forces such as surface tension and adhesion. The critical forces acting on a submicron particle are those that are manifestations of electrostatic attraction and repulsion over ranges that are typically thought of as short in the macroscopic world but which are comparable to the size of the particles in the submicron regime.

At dimensions of 0.10 microns and less, most semiconductor substrates will need to use conductive materials with low dielectric constants (low-k materials), and such materials are inherently delicate. Low-k materials known in the art include: fluorinated silicate glass (FSG); hydrido organo siloxane polymer (HOSP); low organic siloxane polymer (LOSP); nanoporous silica ("Nanoglass"); hydrogen silsesquioxane (HSQ); methyl silsesquioxane (MSQ); divinysiloxane bis(benzocyclobutene) (BCB); silica low-k (SiLK); poly(arylene ether); (PAE, "Flare", "Parylene"); and fluorinated polyimide (FPI). As a result, the emphasis in techniques such as CMP has become more "chemical" than "mechanical," and there has even been a move towards abrasive free methods. It is also becoming more important to have CMP formulations that are not overly aggressive to delicate materials used with these intricate geometries due to the added problems such as erosion and delamination. Accordingly, a need exists for an effective CMP chemistry that will effectively remove small dimension contaminants without deleterious effects on manufacturing materials.

In most manufacturing processes, the substrate must not only be cleaned with a cleaning agent after each process step but must also be rinsed to remove residual cleaning agent before the next step. For example, an amine based cleaning agent can leave trace amounts of amine, which may be corrosive to metal substrates such as aluminum. Thus, a post-cleaning treatment is necessary to neutralize residual amines. Traditionally, an unreactive organic solvent may be used to dilute such reactants, and then a solvent of higher vapor pressure, such as isopropanol, is used to rinse away and dry the substrate. However, as previously mentioned, the flammability of such solvents is a disadvantage.

Preferred rinsing agents will selectively neutralize chemicals without reacting with other materials. An example of a commonly used rinsing chemistry is dilute $NH_4OH$ with dilute HF for post-CMP cleaning of tungsten wafers. Dilute HF is commonly used to remove the remaining monolayer amounts of organic or inorganic contaminants including metals and anions, but unlike organic chemistries, even dilute HF can damage the semiconductor substrate if not carefully controlled. Formulations that are safe and selective for post-cleaning and post-CMP rinsing are presented in U.S. Pat. Nos. 6,156,661 and 5,981,454 both of which are incorporated herein by reference.

In addition to neutralizing cleaning chemicals, it is also important to prevent redeposition of contaminants after cleaning. Isopropyl alcohol, deionized water, and ultrasonic or megasonic cleaning have traditionally been used in various combinations to remove particles, but other means of removal, both physical and other, have also been used.

One means of removal is megasonics, in which high pressure waves in a liquid solution push and tug at contaminants on a surface, effectively dislodging them. It has been found, however, that megasonics is only effective at removing particles as small 0.3 microns and is not expected to be effective at removing particles that are an order of magnitude smaller. Scrubbing and related techniques have been found to be an improvement upon megasonics.

An example of a physical means of removing particles is buoyancy. Buoyancy is illustrated in Japanese Patent No. 63-239982-A2 and U.S. Pat. No. 4,817,652, where it was shown that gas bubbles could lift dust particles away from the surface of a semiconductor substrate. Gas bubble formation in liquid solution was induced around dust particles, and the buoyancy of the gas bubble released and lifted the particle from a substrate to the surface of the solution. Surface tension forces were described as part of the particle removal mechanism in that the film encasing the bubble would rapidly converge underneath the particle and detach the particle from the surface of the substrate. Thus, a buoyant force is used to overcome an adhesive force. If the surface tension between the liquid and the substrate is higher than that between the liquid and the particle, the liquid will prefer to remain attached to the substrate. Consequently, the liquid will prefer to pass between the particle and the substrate rather than just pass over the particle.

A further example of a physical means of removal is based upon the use of differences in interfacial surface tension. In U.S. Pat No. 4,781,764, an advancing and retracting "interface of a liquid" was taught as a method of detaching particles from the surface of substrates that were too small to be effectively removed using megasonics. The important surface tension relationship is the difference between two values: the interfacial surface tension between the liquid and the substrate and the interfacial surface tension between the liquid and the undesired matter. The movement of the liquid film over a surface creates a force on that surface, and the amount of force created depends on the interfacial surface tension between the liquid and the surface. As such, differences in interfacial surface tensions between the undesired matter and the semiconductor substrate assist in removing particles by "scrubbing" undesired matter from the semiconductor substrate. This physical means of removal was found to be an improvement over the use of megasonics in the removal of smaller particles.

Thus, since some residues are more effectively removed through chemical techniques, while others are more effectively removed by interfacial scrubbing, there is a need for a cleaning technique that is effective at removing a variety of substances at the scales required for the dimensions of the features on current and future semiconductor wafers. Such a technique must also be capable of being used efficiently in an industrial environment and a variety of formulations.

A foam is an agglomeration of gas bubbles separated from one another by a thin liquid film. In U.S. Pat. Nos. 6,090,217 and 6,296,715 B1, both of which are incorporated herein by reference, a foam was taught as useful for drying, cleaning and chemically treating a substrate. Cleaning chemicals such as ammonium hydroxide, hydrofluoric acid, hydrogen peroxide and nitric acid were reported, though all of these have known corrosive effects on delicate substrates and patterns deposited on substrate surfaces. However, foam compositions utilizing non-aqueous solvents in combination with cleaning chemicals were not disclosed. In particular, foam formulations that included corrosion inhibitors or chelating agents were not disclosed. Furthermore, foam techniques for removal of post-etch residue, or for carrying out CMP, were not taught.

A preferred method of foam formation, as described in U.S. Pat. Nos. 6,090,217 and 6,296,715, was the introduction of carbon dioxide gas into a liquid solution, accompanied by appropriate controlled variations of pressure to create a foam. Although carbon dioxide has a surface-tension reducing effect on an aqueous solution, at higher concentrations it produces an acidic solution and may not be compatible with other cleaning reagents. Other methods of facilitating foam production involved the addition to a liquid formulation of surface-tension reducing agents such as surfactants. A foam that could remain stable for approximately one to two minutes could deliver cleaning chemical to the semiconductor substrate using about one tenth of the amount of liquid and chemical normally required to achieve the necessary concentration, thus achieving a cost saving.

It was envisaged that the foam bubbles individually wetted the substrate surface, thereby forming a continuous film of liquid over the substrate surface that replicated the action of an equivalent liquid formulation but at considerably less cost. During foam application, the foam flowed over the substrate, and eventually discharged into an overflow container before decaying and draining. A disadvantage of using foam was that the foam must remain stable and in contact with the substrate long enough to deliver cleaning chemical. It was also envisaged that foam action was attributable, at least in part, to a "scrubbing" effect in which the substrate moves relative to the foam and the mass of foam bubbles dislodges particles from the surface.

Nevertheless, although an advantage of foam compositions and processes is that less liquid and chemical is necessary to achieve the same amount of cleaning as that achieved using liquid phase semiconductor cleaning, etching, and rinsing technology, formulating effective foam chemistries is difficult. Unpredictable criteria such as effective means of foam production and stability militate against universal applicability of foam techniques, however. A further principal disadvantage of current foam technology is that it doesn't provide methods and foam compositions for chemicals that are capable of cleaning post-etch residue.

SUMMARY OF THE INVENTION

Accordingly, the present invention teaches foam compositions and methods suitable for cleaning, rinsing, and etching of substrates, according to a variety of chemical formulations. These methods and compositions are selective in the removal of organic and inorganic compounds including post-etch residue. Furthermore, the process can operate with a range of foam stabilities.

According to the present invention, there is provided a process with a variety of foam compositions for treatment of a substrate having a surface to which undesired matter adheres. The foam is generated from a liquid composition that includes at least one surfactant that facilitates foaming, by introducing a gas into the liquid composition. A foam composition for treating the surface of a substrate according to the methods of the present invention comprises: a gas; a surfactant; deionized water; and a component selected from the group consisting of a fluoride, a hydroxylamine, an amine and periodic acid. Secondary components such as additional surfactants, chelating agents, corrosion inhibitors, and acids and bases are optionally added to further control surface tension, scavenge metals, inhibit oxidative side reactions, and control pH, respectively. The foam is caused to contact the surface of the substrate under reaction conditions sufficient for treatment, and the undesired matter is then removed when the foam composition is removed.

Foam processes can offer a large number of benefits. For example, foams allow the use of less chemical than corresponding liquid compositions. Additionally, according to the methods and compositions of the present inventions, foams that function at temperatures lower than about 100° C. are disclosed. The low volume of solution, the potentially low operating temperatures and the unique physical composition of a foam medium, all tend to slow diffusion and result in a reduction in the amount of impurities capable of redepositing on the substrates through adsorption and readsorption.

A foam composition according to the present invention comprises: a gas; a surfactant; deionized water; and a component selected from the group consisting of a fluoride other than HF, a hydroxylamine, an amine and periodic acid. A foam composition according to the present invention preferably comprises: at least one fluoride compound that is free of both organoammonium and amine carboxylate compounds; at least one solvent; at least one gas; at least one surfactant; and water. A foam composition also preferably comprises: at least one hydroxylamine; at least one alkanolamine; at least one gas; at least one surfactant; and, at least one solvent. A foam composition also comprises: at least one amine; at least one solvent; at least one gas; and at least one surfactant. A foam composition according to the present invention also comprises: periodic acid; at least one gas; at least one surfactant; and deionized water. Any foam composition according to the methods of the present invention is suitable for treating a substrate to which undesired matter adheres for the purpose of removing the undesired matter.

Foams according to the present invention can additionally contain chelating agents and corrosion inhibitors to aid in preventing adsorption and readsorption of metals on the surface of the substrate and reduce undesired oxidation reactions. Further, foam processes are safer than currently practiced liquid-based techniques because foams require the handling of less potentially hazardous chemical. As such, foam processes provide increased safety, decreased material costs, and increased product performance when compared to entirely liquid phase processes. Effective utilization of physical means such as surface tension forces and buoyancy, when combined with the chemical means of effective cleaning formulations, can provide a synergistic cleaning effect that can surpass the effectiveness of prior art cleaning means.

The cleaning power of the foams of the present invention is envisaged to occur by one or more of a number of mechanisms. The cleaning mechanism is thus not limited strictly to chemical action on a substrate surface but also includes the mechanisms of bubble formation, scrubbing, and bubble bursting, alone or in combination with one another. Bubble formation removes undesired matter from the surface of a substrate through movement of the liquid film between the undesired matter and the substrate surface so that the resulting buoyancy lifts away undesired matter. Scrubbing removes undesired matter from the surface of the substrate through the movement of the liquid film in a way that creates surface tension differences that give rise to a force during movement of the liquid film. Moreover, bubble bursting energy significantly complements cleaning power. Foam compositions also enable application of a low and uniform pressure to the wafer surface for precision CMP and serve equally well in post-clean and post-CMP rinsing.

The present invention is particularly selective in removing post-etch residue from the surfaces of semiconductor substrates which comprise vias and low-k dielectrics without affecting structural integrity and detail. The foam compositions can also remove particles smaller than 0.3 microns in size from the surface of the semiconductor substrate, operate at low temperatures, have a low etch rate of silicon dioxide, reduce the quantity of undesired material available for redeposition on the substrate, and inhibit corrosion. Moreover, much less chemical and liquid is required for treatment of the substrate.

DETAILED DESCRIPTION OF THE INVENTION

Figure 1:
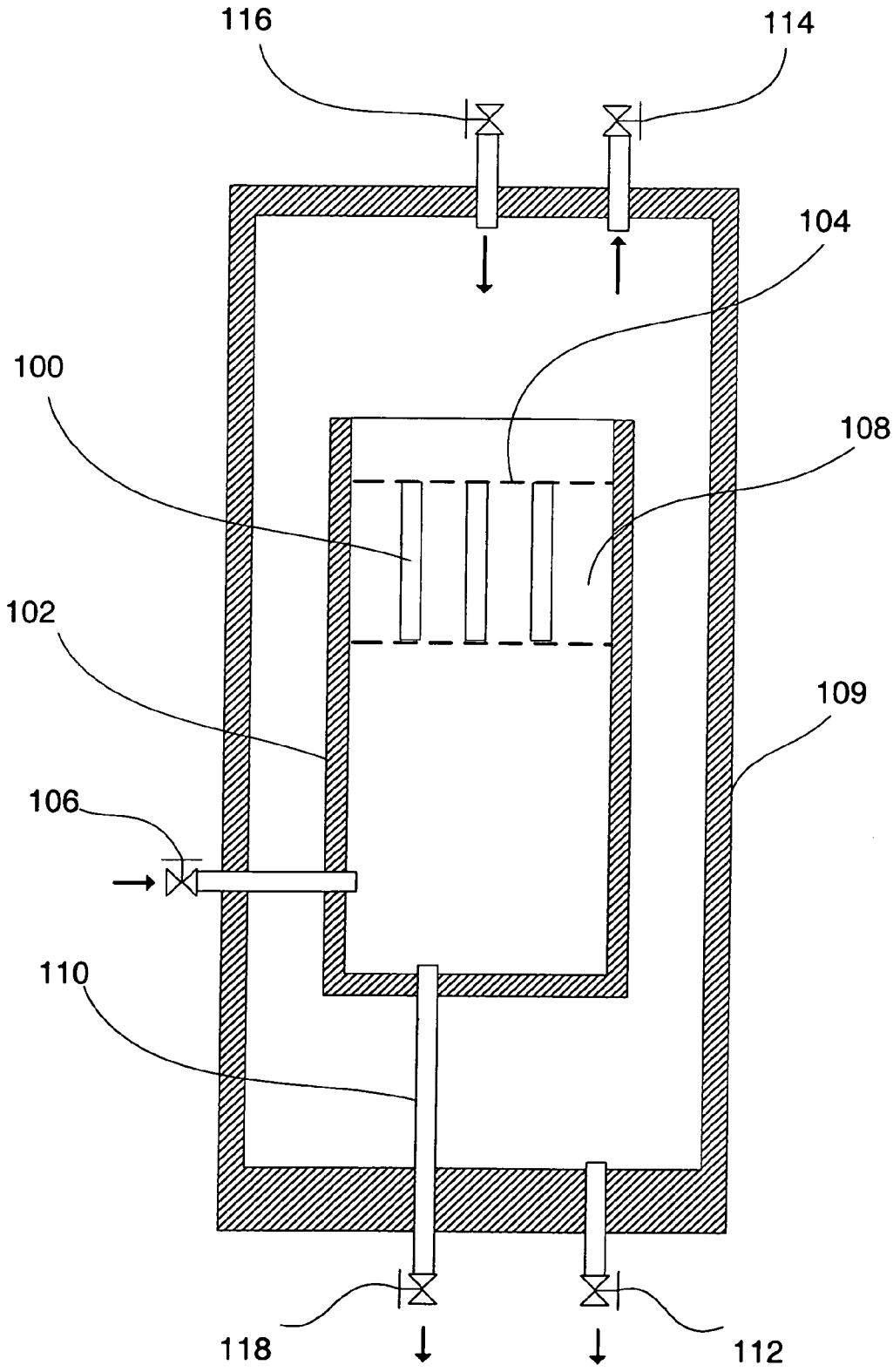
FIG. 1 is a diagram of an apparatus for foam cleaning processes as described herein.

The present invention includes foams formed from liquid compositions that comprise chemical reagents. The present invention also comprises use of such foams to etch, clean, and rinse substrates. The foam processes and compositions of the present invention are particularly suitable for working with the intricate fine-scale structures developed on semiconductor wafers during semiconductor manufacturing processes. The foam processes and compositions of the present invention combine the properties of foams with chemical activity to achieve a high cleaning efficiency, low material cost, and improved safety over commonly used liquid phase cleaning processes.

According to the methods and compositions of the present invention, a substrate is an underlying solid material used in manufacturing. In a preferred embodiment of the present invention, substrates are the underlying solid materials used in manufacturing products such as integrated electronic circuitry and microelectromechanical systems (MEMS). In a particularly preferred embodiment of the present invention a substrate is a semiconductor wafer, such as a wafer of silicon. As would be understood by one of skill in the art, it is not intended that the methods and compositions of the present invention are limited to particular substrate materials.

The present invention also provides for foam compositions that are non-flammable, have low etch rates of silicon dioxide, and are capable of safely and selectively removing post-etch residue from metals, vias, and low-k dielectrics. The foam compositions of the present invention are also applicable to CMP and lead to improved planarization of integrated circuit layers by providing a chemical delivery medium that requires less pressure to distribute and less chemical to operate. Post-cleaning and post-CMP rinse can likewise benefit from the advantages of the foam technology of the present invention by the synergistic effect of the foam combined with an effective cleaning or rinsing chemistry.

According to the methods and compositions of the present invention, a foam comprises an agglomeration of bubbles separated from each other by thin liquid films, wherein the composition of the liquid can comprise any number of components such as water or deionized water, acid, base, surfactant, and various chemicals capable of chelating metals, inhibiting corrosion, and cleaning undesired matter from the surface of a substrate. Ideally, the foam is formed by imparting mixing energy to the liquid composition, either by agitating the liquid composition in the presence of a preferred gas, introducing a preferred gas into the liquid composition, or by lowering the overall pressure of a gas saturated liquid composition.

Undesired matter that is preferably removed from the substrate surface according to the methods of the present invention includes organic and inorganic materials, such as particles, films from photoresist material, and traces of any other impurities including metals deposited while implanting material on the surface of the substrate or the residue created while etching the surface of the substrate. Undesirable material also includes particulate matter that is left after a planarization process step, wherein it is understood that planarization is removal of a layer, for example an oxide layer after an etching step.

The foam compositions of the present invention comprise at least one chemical agent; at least one solvent; at least one gas; at least one surfactant; and water. The foam compositions also additionally comprise one or more of the following: a chelating agent; a corrosion inhibitor; and one or more acidic or basic compounds for the purpose of maintaining the pH of the composition, when in liquid form, within a specified range. In some embodiments the solvent itself can be water.

The chemical agent of the present invention is preferably selected from the group consisting of: a fluoride, a hydroxylamine, an amine and periodic acid.

Where water is present in the foam compositions of the present invention it is preferably deionized water, and even more preferably high purity deionized water.

The gas that is found within the bubbles of the foam compositions of the present invention is preferably selected from the group consisting of: nitrogen, argon, helium, air, oxygen, carbon dioxide, and ozone. The gas is more preferably nitrogen or argon. In one embodiment the gas is air. In another embodiment, the gas is oxygen. The gas may also be carbon dioxide in a less preferred embodiment.

Surfactants are surface active agents and are integral to the present invention where the chemical agent will not lower the surface tension of the solution sufficiently on its own to facilitate foam formation. Surface activity is defined by the activity of molecules at an interface, where the interfaces of importance in the present invention include the interface between the liquid film surrounding the gas within the foam bubble; the interface between the cleaning composition and the undesired matter; and, the interface between the cleaning composition and the surface of the semiconductor substrate. As is known to one of skill in the art, surfactants typically consist of molecules that contain both polar and non-polar functional groups. The choice of surfactant balances the tendency of molecules to pack together at an interface with the tendency of the molecules to diverge from an interface. Adsorption at an interface between a solid and a liquid lowers the interfacial surface tension, and as the interfacial surface tension decreases, the solid is more readily wet by the liquid.

Foam stability can be increased by surfactants that resist drainage of the liquid film around the foam bubble, a process which results in eventual rupture. A balance of forces is reached where the drainage stops at a certain film thickness. The foam compositions of the present invention preferably comprise at least one surfactant selected from the group consisting of: anionic surfactants, cationic surfactants, non-ionic surfactants, amphoteric surfactants, and silicone based surfactants, wherein at least one surfactant is suitable to allow foaming of a liquid formulation. Especially preferred surfactants are poly(vinyl alcohol) and poly(ethyleneimine).

The corrosion inhibitors that are optionally included in the foam compositions of the present invention are preferably inorganic nitrate salts such as ammonium, potassium, sodium and rubidium nitrates, aluminum nitrate and zinc nitrate.

The chelating agents that are optionally included with the foam compositions of the present invention are typically organic molecules and are preferably bidentate, tetradentate, hexadentate or octadentate. Examples of suitable chelating agents are found in commonly assigned U.S. Pat. No. 6,117,783, at col. 8, lines 36 to 49, and in commonly-assigned U.S. Pat. No. 6,156,661, at col. 8, lines 52 to 63, though the entirety of both of these patents are incorporated herein by reference.

Some foam formulations of the present invention require the addition of acids and/or bases to adjust the pH to an acceptable value. The acids suitable for use in the present invention are organic or inorganic. The important factor is the solubility of the acid and base products in any additional agents in the liquid solutions.

The bases suitable for use to adjust the pH of the cleaning solution can be composed of any common base, i.e., sodium, potassium, magnesium hydroxides, or the like. Such bases are problematic, however, because they introduce mobile ions into the foam formulation which can be damaging to today's semiconductor chips. Preferred bases therefore include choline (a quaternary amine) or ammonium hydroxide.

Cleaning

Cleaning the surface of a substrate using the foam process of the present invention does not require the large quantity of chemical that is used by a liquid phase process. The quantity of cleaning chemical that is present in the liquid from which the foam are formed is found to be sufficient to remove undesired matter from substrate surfaces. This is especially true for the surfaces of semiconductor substrates, since integrated circuit manufacture already utilizes very rigorous procedures that ensure the cleanliness of the various steps in the process.

The methods of the present invention are particularly suited to cleaning semiconductor wafer surfaces that have fine-scale features such as vias, circuit pathways, and other circuit components. For the purposes of the present invention, small particles that constitute undesired matter and fine-scale features on substrate surfaces, such as those that have been engineered during integrated circuit manufacture, preferably have at least one dimension that is less than about 1 micron. More preferably at least one dimension of a small particle of undesired matter or of a fine-scale feature is less than about 0.1 micron. Even more preferably, at least one such dimension is less than about 0.07 microns. Most preferably, at least one such dimension is as small as about 0.007 microns. For the purposes of the present invention, a dimension can be a length, height, breadth, radius, thickness or diameter of a particle or fine-scale structure. For example, an approximately spherical particle of undesired matter that may be removed by the methods of the present invention may have a diameter of slightly less than 0.1 microns. As another example, a circuit component on the surface of a semiconductor substrate may have a width of about 0.08 microns. One of skill in the art will appreciate that the aforementioned dimensions are purely exemplary and the methods and compositions of the present invention may be applied to remove undesired matter of a continuous range of sizes from substrate surfaces. For the purposes of the present invention, cleaning can comprise removal of post-etch residue as well as other particulate matter.

The foam compositions and processes of the present invention may also be used for etching. Formulations that may accomplish cleaning of a substrate may also have the effect of etching a substrate. Thus, it is appropriate to consider etching and cleaning as related processes such that apparatus and steps carried out for cleaning a substrate may also be contemplated for etching. In particular, etching itself may be regarded as a form of corrosion.

FIG. 1 is a diagram of an apparatus that can be used to perform foam cleaning processes as described herein. At least one substrate 100 is placed within a treatment vessel 102. Preferably substrate 100 is one of a batch of substrates that are treated simultaneously by the processes of the present invention. Substrate 100 is preferably a semiconductor substrate such as a silicon wafer. Substrate 100 is held by a holding device 104 that allows foam to move relative to semiconductor substrate 100. The region around substrate 100, within treatment vessel 102 is referred to as cleaning zone 108. An inlet 106 to treatment vessel 102 provides a pathway to inject gas, gas and liquid, or foam to provide cleaning energy in cleaning zone 108. Alternative embodiments of the present invention can optionally include multiple inlets to facilitate such injections so that gas, liquid, foam, or more than one composition of each can be injected separately of one another as desired. Furthermore, an inlet such as inlet 106 can be used to replenish volumes of foam or liquid solution in treatment vessel 102 during treatment. A space 110 in outer vessel 109 is used to facilitate any one or more of the following procedures: maintain pressure while a liquid saturated with gas is pumped into treatment vessel 102 through inlet 106; drain spent cleaning composition from drain 112; or, collect gas released from the foam cleaning medium during the process to purge from gas release outlet 114. The pressure in outer vessel 109 can be maintained by introducing gas through inlet 116. The treatment vessel can be cleaned and drained by releasing material through drain 118. It is consistent with the methods of the present invention that foam might only cover a selected portion of substrate 100.

Figure 2:
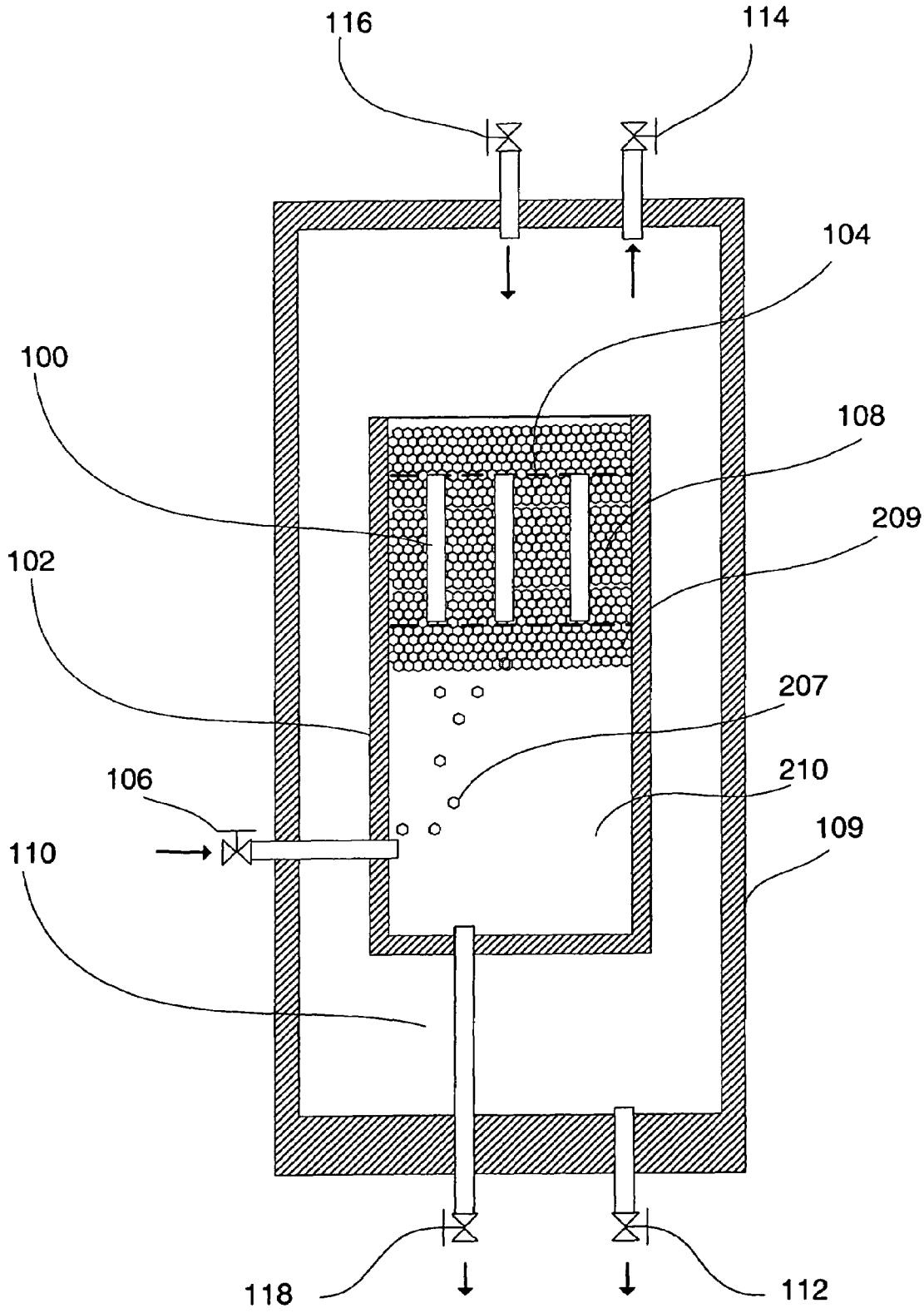
FIG. 2 is a diagram illustrating an apparatus for foam cleaning without plug flow.
Figure 3:
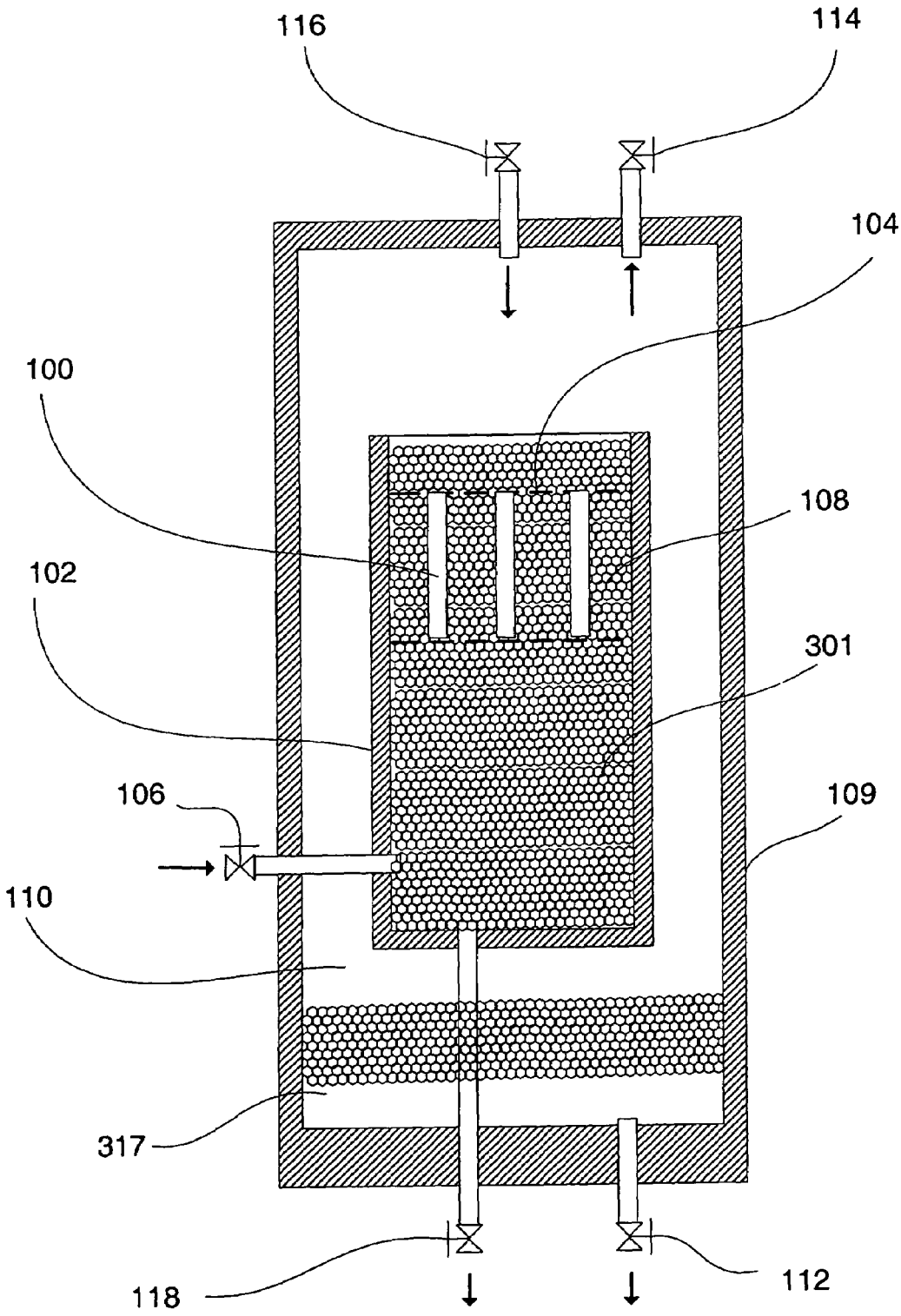
FIG. 3 is a diagram illustrating use of an apparatus for foam cleaning with plug flow.

FIGS. 2 and 3 illustrate how an apparatus, such as the apparatus in FIG. 1, can be used for foam cleaning of a substrate 100. In FIG. 2, foam in cleaning zone 108 is shown in contact with substrate 100. FIG. 3 illustrates foam cleaning with plug flow, where plug flow is a continuous unidirectional movement, or flux, of the foam composition over the substrate surface.

A first embodiment of the foam-based process of the present invention is shown in FIG. 2, wherein at least one substrate 100 is placed within treatment vessel 102 and held by a holding device 104. A cleaning solution 210 is introduced through inlet 106. It is understood that alternative embodiments of the present invention can optionally include multiple inlets to facilitate introduction and replenishment of cleaning solution so that gas, liquid, foam, or more than one composition of each can be injected separately of one another as desired. Furthermore, an inlet such as inlet 106 can be used to replenish volumes of foam or liquid solution in treatment vessel 102 during treatment. A gas is then introduced through treatment vessel inlet 106 to create bubbles 207. Foam 209 is formed from cleaning solution 210 as an aggregate of bubbles 207 in the cleaning zone 108. Preferably, foam 209 covers the entire surface of substrate 100 for the requisite treatment time. An advantage of this embodiment is that foam 209 need not be stable, and the presence of bubbling not only adds energy to remove undesired matter, but the bubbles 207 also displace volume. The displacement of volume reduces material cost by requiring less liquid, and therefore less chemical, in the treatment of substrate 100. Material cost is also reduced in that less equipment is necessary for storage and transport of the liquid. Energy cost is reduced in that a smaller amount of liquid transported translates into smaller requirements for equipment such as pumps, valves, mixers, etc., and these smaller equipment requirements result in the consumption of less energy. Outer vessel 109 is optional in this embodiment.

It is envisaged that, while foam 209 is in contact with substrate 100, the bubbles 207 in foam 209 burst and facilitate removal of particles from the surface of the substrate 100. The longevity of foam 209 depends upon the relative rates of formation and bursting of bubbles 207. The bubbles 207 can have a formation rate that surpasses the burst rate, which will result in overflow of spent foam from the top of treatment vessel 102. In this case, additional cleaning solution 210 is preferably added during the treatment period to maintain bubble coverage over the surface of the semiconductor substrate 100. Alternatively, bubbles 207 can have a formation rate equal to the burst rate, which will result in no overflow from the top of treatment vessel 102. In this case, the dirty cleaning solution is eventually forced to overflow from treatment vessel 102 by adding either fresh cleaning solution 210 or a rinsing solution 210, with or without bubbling. The fresh cleaning solution 210 or rinsing solution 210 is allowed to drain through outer vessel drain 112.

According to a second embodiment, foam cleaning is achieved with plug flow. A goal of the plug flow process is to supply substrate 100 with fresh cleaning chemical that is largely unreacted and substantially free of undesired matter that could deposit or redeposit on substrate 100. As illustrated in FIG. 3, a substrate 100 is placed within treatment vessel 102 and held by a holding device 104. A cleaning composition is introduced through treatment vessel inlet 106 into treatment vessel 102 at either a pressure high enough to inhibit foaming, or at a pressure low enough to permit foaming. Outer vessel 109 is pressurized by adding gas through outer vessel inlet 116. Accordingly, formation of foam 301 in treatment vessel 102 can be controlled by altering the pressure present in the outer vessel 110 as desired. An advantage of initiating bubble formation after the liquid is introduced into the treatment vessel is that bubbles may form with the undesired matter serving as the nucleus for bubble formation. It is thus envisaged that bubbles can then either remain stable and lift undesired matter from substrate 100 or burst and release undesired matter from substrate 100. Another advantage of this embodiment is that the bubbles need not be stable: continuous formation of bubbles not only adds energy to remove undesired matter, but also displaces volume within the treatment vessel 102, thereby reducing material and energy cost in the manner previously discussed. The presence of any cleaning solution in the liquid film of foam 301 will simultaneously clean through chemical action. Furthermore, the use of gas under pressure will help force liquid into small cracks, crevices, and openings on the surface of substrate 100, thereby improving the efficiency of the cleaning process.

Foam stability depends on the tendency of the liquid film to drain and become thinner, and some foams can remain stable almost indefinitely if there is no disruption due to random physical or chemical disturbances. Other factors such as gas diffusion and evaporation also influence foam stability. Bubbles are considered to be unstable in the present invention where bubbles are bursting while foam remains in contact with the substrate. However, as the bubbles increase in stability, the material and energy savings continue to increase proportionate to volume displacement. Preferably, the foam 301 should have sufficient instability to flow through the outer vessel drain 112 at a rate that exceeds bubble formation in order for the flow out of the system to at least equal the flow into the system to facilitate drainage of spent foam 317.

In a third embodiment as shown in FIG. 3, the cleaning composition can be allowed to foam upon entry into treatment vessel 102 by maintaining a pressure drop between a cleaning composition supply tank (not shown) and outer vessel 110, wherein gas in outer vessel 110 is at a pressure low enough to allow foaming. The pressure drop is maintained without the use of a pump by pressurizing the cleaning composition supply tank with the gas chosen for foaming. Pressurizing the cleaning composition supply tank also ensures that the cleaning composition is saturated with gas. The foam 301 then rises into cleaning zone 108 to cover and act upon the surface of the substrate 100 as the cleaning composition enters treatment vessel 102 through inlet 106. The advantage of maintaining a pressure drop is that the cleaning composition does not need to be pumped from the separate supply tank to treatment vessel 102 but rather the cleaning composition will flow in the direction of the pressure drop. Thus, contaminants that arise from the action of moving parts found within equipment such as pumps, valves and mixers can be reduced. Further, where pumps are preferred or necessary, the cleaning compositions can be pumped into the treatment vessel 102 if the pressure is kept high enough to inhibit foaming during transport.

In a fourth embodiment of the present invention as shown in FIG. 3, the cleaning composition is foamed in a vessel separate from the treatment vessel 102 by either adding energy to the composition by some mechanism such as a mixer or by simply bubbling gas into a liquid composition. The foam 301 is then transported to treatment vessel 102 in such a way that foam 301 continuously flows over the surface of semiconductor substrate 100. One advantage of this embodiment is that material and energy savings are maximized since the foam 301 must be stable enough for transport to treatment vessel 102. With relatively stable foam 301, the maximum volume of cleaning solution is displaced while still maintaining coverage of semiconductor substrate 100. Another advantage is that a retrofit or future modification of existing cleaning equipment may be simplified when producing foam 100 in a separate vessel and transporting the foam 100 to treatment vessel 102.

Any or all of the embodiments described hereinabove may additionally involve moving substrate 100 with respect to the foam in order to amplify the cleaning effect of the foam formulation. Moving a substrate can comprise agitating, rotating, or causing the substrate to change its angle of declination with respect to the vertical, as well as moving the substrate up, down or sideways, within the foam.

Figure 4:
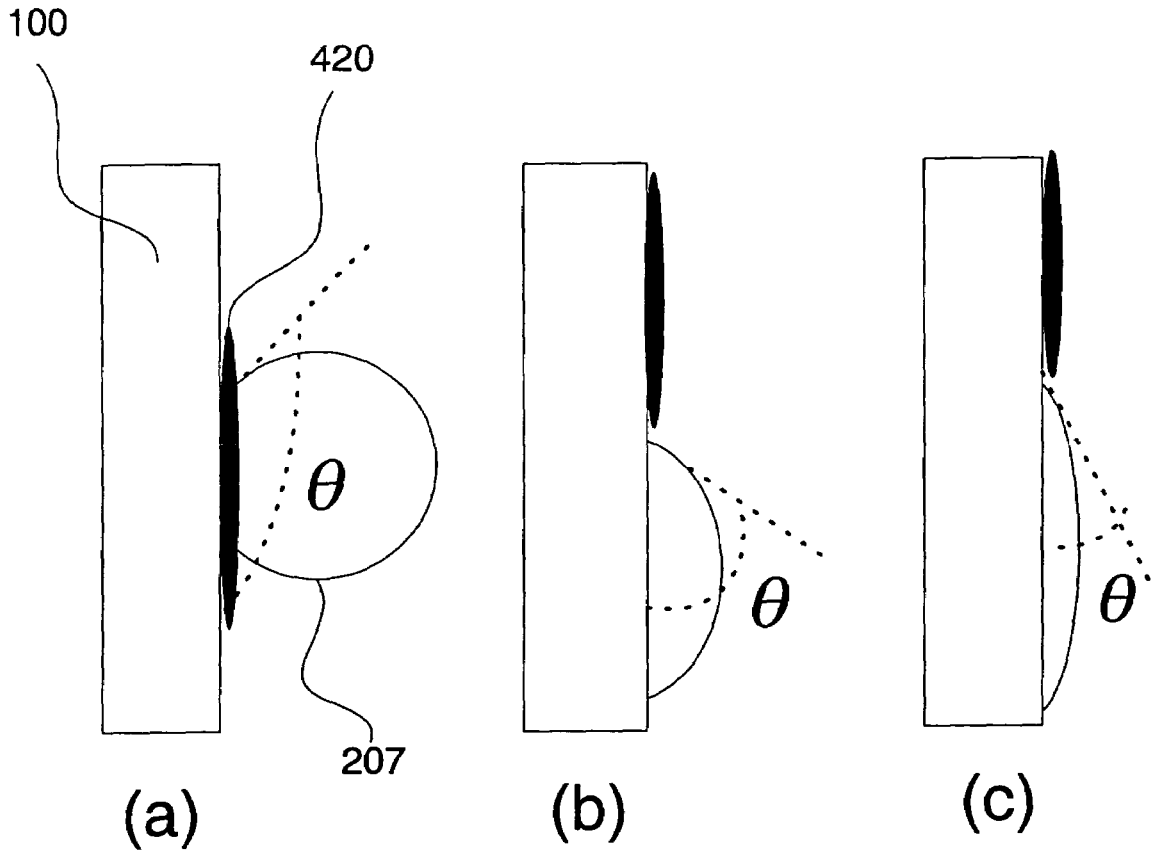
FIGS. 4(*a*), (*b*), and (*c*) describe the various degrees of wetting that may be present in the foam cleaning processes described herein.

FIGS. 4(*a*), (*b*), and (*c*) describe various degrees of wetting that may be present in the foam cleaning processes described herein. Undesired matter 420 does not necessarily have to be wet by a bubble 207 of cleaning solution in order to be removed as long as the substrate 100 itself is wet by the cleaning solution. As is understood by one of skill in the art, wetting occurs when the contact angle between the liquid film around bubble 207 and contacting substrate 100 is less than 90 degrees. The smaller the contact angle, the greater the degree of wetting. In FIG. 4(*a*), undesired matter 420 is not wet by the liquid film around bubble 207. In FIGS. 4(*b*) and 4(*c*), substrate 100 is wet by the liquid film around bubble 207. In FIG. 4(*c*), the wetting of substrate 100 is greater than that shown in FIG. 4(*b*), as indicated by the smaller contact angle. In particle removal, the important surface tension relationship is the difference between two values: the interfacial surface tension between the liquid film around bubble 207 and substrate 100 and the interfacial surface tension between the liquid film around bubble 207 and the undesired matter. The movement of the liquid film over a surface creates a force on that surface, and the amount of force created depends on the interfacial surface tension between the liquid and the surface. As such, differences in interfacial surface tensions between the undesired matter 420 and semiconductor substrate 100 assists the chemical action by scrubbing undesired matter 420 from semiconductor substrate 100.

Accordingly, in a fifth embodiment, there is a difference in surface tension between the liquid film around bubble 207 and undesired matter 420, and the liquid film around bubble 207 and semiconductor substrate 100. Thus, the movement of the liquid film around bubble 207, whether the liquid is advancing, retracting or continuously flowing over the substrate, creates the scrubbing action that can remove particles. The advantage of this embodiment is that the cleaning solutions can be selected with the goal of maximizing bubble bursting energy and/or designing surface tension differences.

Figure 5:
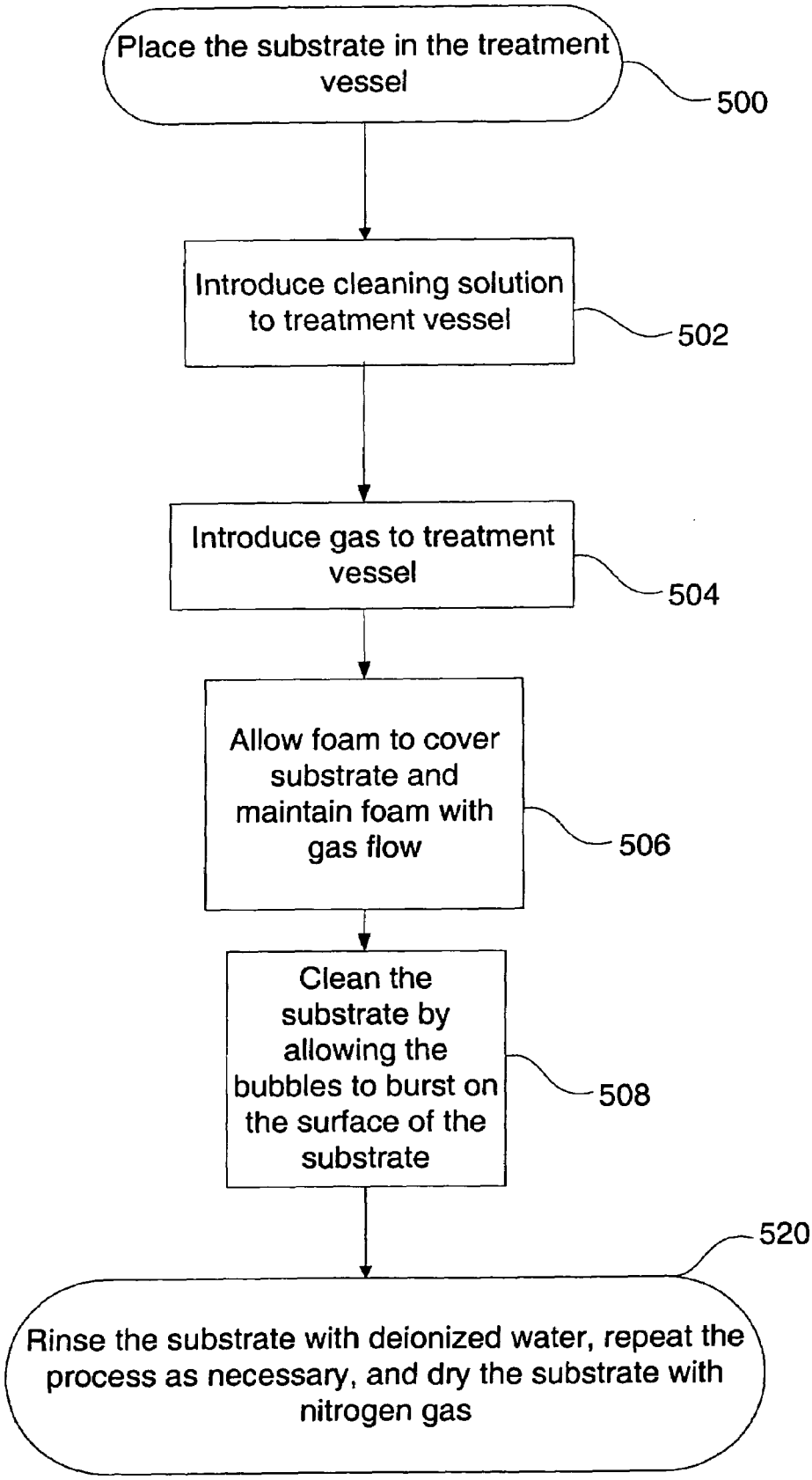
FIG. 5 is a flowchart describing foam cleaning without plug flow.

FIG. 5 is a flowchart of the first embodiment of the method of the present invention as may be practiced with the apparatus illustrated in FIG. 2. A substrate 100 is placed 500 in a treatment vessel 102, and sufficient cleaning solution is introduced 502 into the treatment vessel 102 such that foam bubbles of cleaning solution are formed by introducing 504 gas into the solution, and the surface of the substrate is covered by foam, preferably entirely. The foam is maintained by introducing a sufficient flow of gas 506. Cleaning 508 is performed by chemical action, as well as by, or alternatively to, allowing the bubbles to burst on the surface of the substrate. The substrate is then rinsed 520 and the entire process is repeated as necessary with drying of the substrate using a gas such as nitrogen.

Figure 6A:
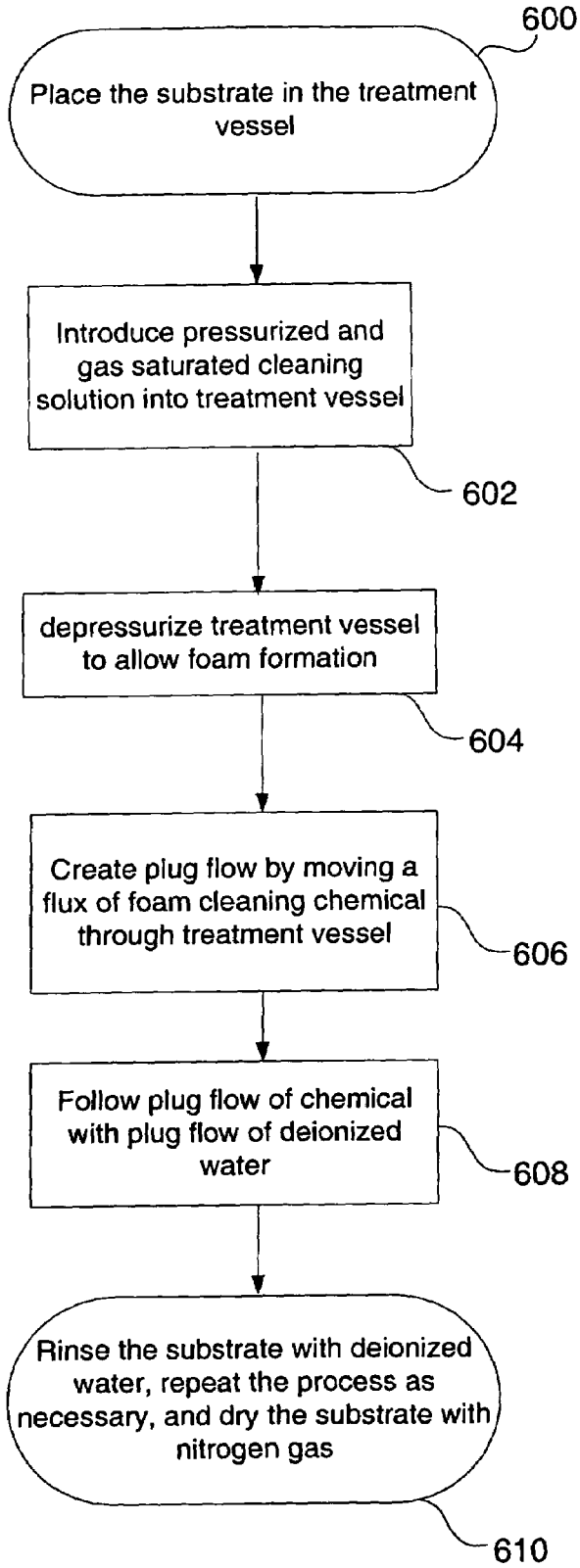
FIG. 6 is a flowchart describing foam cleaning with plug flow.
Figure 6B:
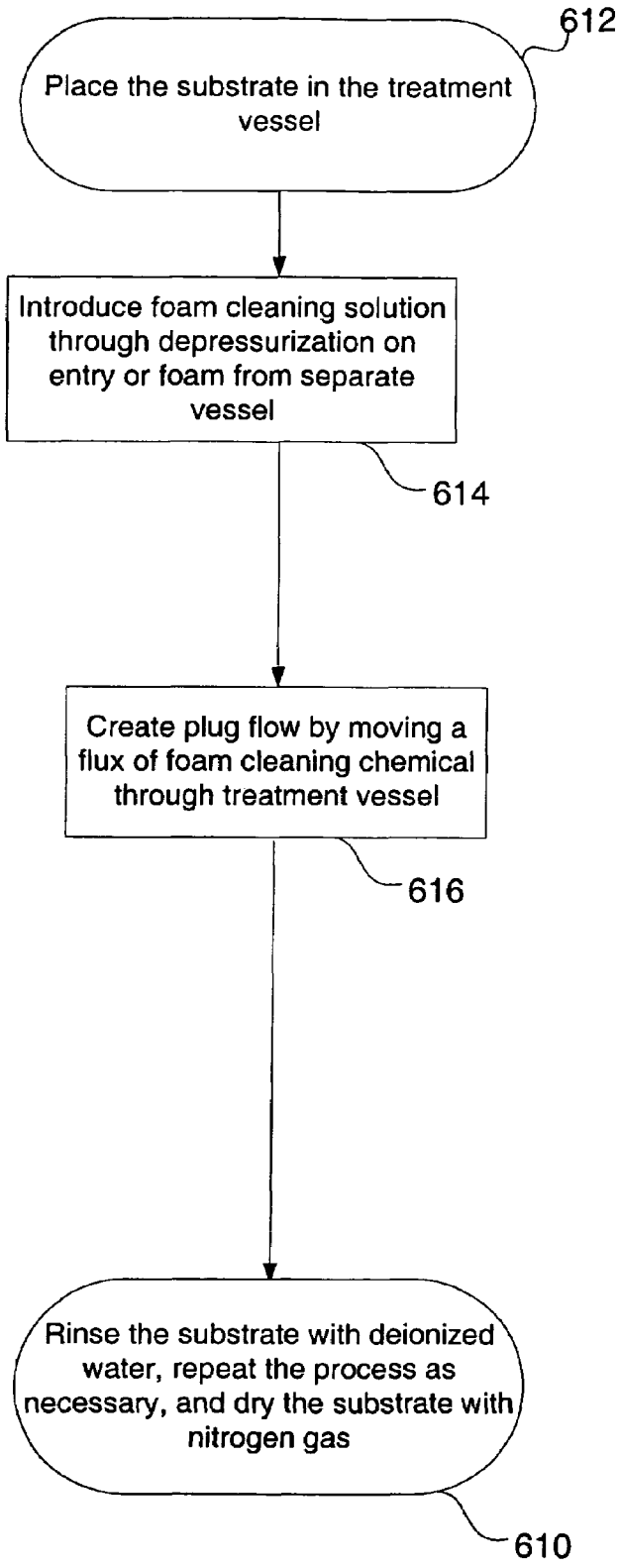

FIG. 6, comprising FIGS. 6A and 6B depict flowcharts of the second and third embodiments as described with respect to the apparatus in FIG. 3, wherein steps 600 through 610 represent the second embodiment and steps 612 through 618 represent the third embodiment. The substrate 100 is placed 600 in treatment vessel 102. In the second embodiment, sufficient pressurized and gas saturated cleaning solution is introduced 602 into the treatment vessel such that foam bubbles of cleaning solution are formed by depressurizing 604 the treatment vessel by releasing gas, for example through outlet 114. In the third embodiment, the foam introduced initially 614, through either a pressure drop, into the treatment vessel 102 or the foam is produced in a first vessel and pushed into the treatment vessel. In both the second and third embodiments, the treatment vessel 102 becomes entirely filled with a flux of foam. The difference between the second and third embodiments is that depressurization does not occur in the second embodiment until the substrate is covered by liquid. It is envisaged that the undesired matter residing on the substrate is used as the nuclei for bubble formation in order to lift away undesired matter with the bubbles. In either the second or third embodiment, it is also understood that undesired matter is removed by mechanisms that include: chemical action, scrubbing which arises from separation of particles from the surface of a substrate through movement of the liquid film, and the utilization of bubble bursting energy. A plug flow of foam is created, steps 606(second embodiment) and 616 (third embodiment), by moving a flux of foam cleaning chemical through the treatment vessel. The substrate is then rinsed 610 (or 618), and the entire process is repeated as necessary with a final drying of the substrate using a gas such as nitrogen.

Figure 7:
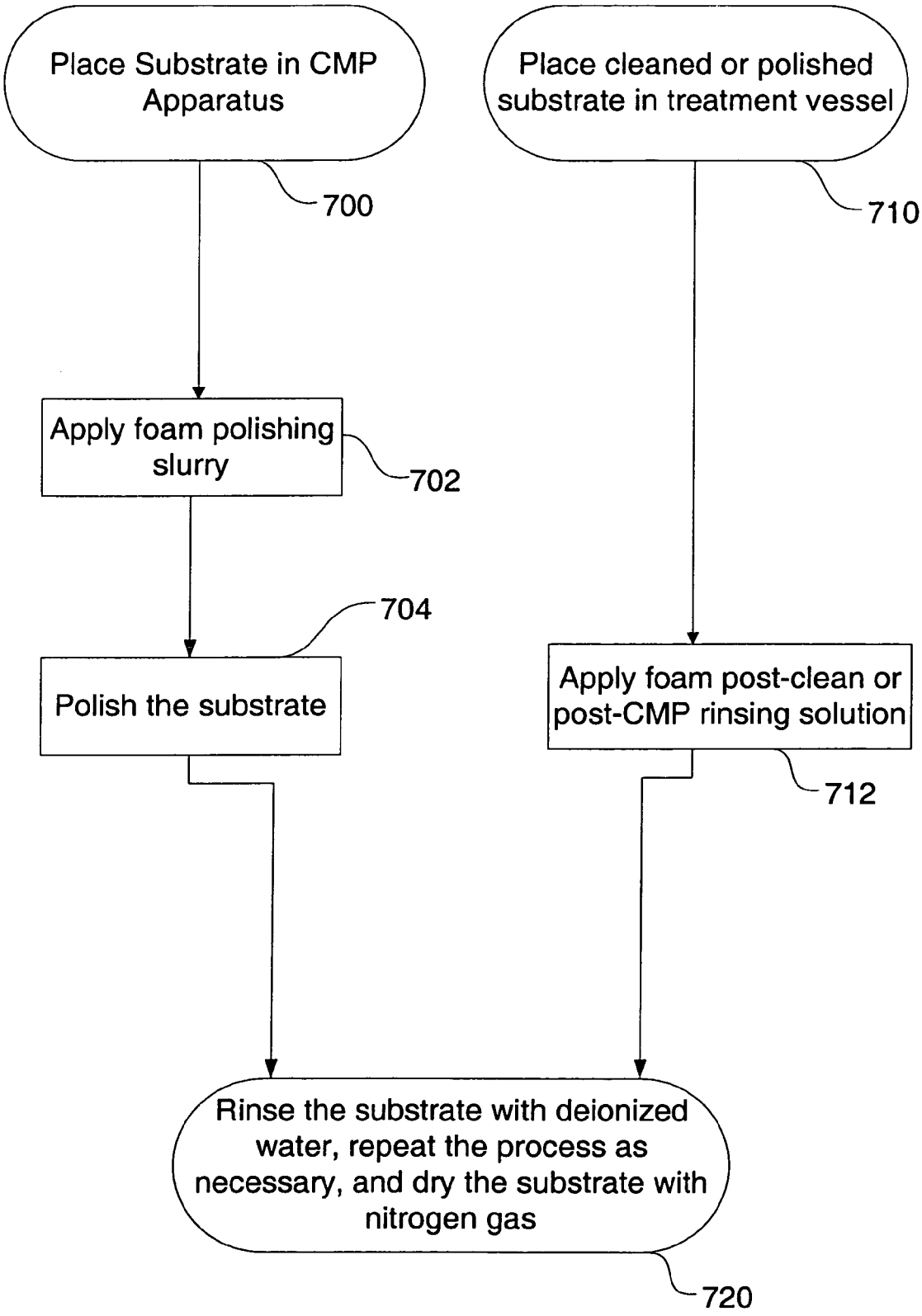
FIG. 7 is a flowchart describing post-clean rinsing, CMP, and post-CMP rinsing.

FIG. 7 is a flowchart of post-clean rinsing, CMP, and post-CMP rinsing treatments. In post-clean rinsing and post-CMP rinsing treatments, the cleaned or polished substrate 100 is placed 710 in the treatment vessel 102. A foam post-clean rinsing or post-CMP rinsing solution is then applied 712 to the substrate 100 using the same methods of FIGS. 5 and 6. In CMP treatments, the substrate is placed 700 into the CMP apparatus. A foam CMP slurry is then applied 702 to the substrate 100 using the same or similar methods of FIGS. 5 and 6. The substrate is then polished 704 using CMP methods and apparatus known to those of skill in the art, which are not the methods and apparatus in FIGS. 1-3, 5, and 6. The substrate is then rinsed 720, and the entire process is repeated as necessary with a final drying of the substrate using a gas such as nitrogen.

Other methods and apparatus that may be used to accomplish application of foam to a substrate, according to the general principles of the present invention, can be found in U.S. Pat. No. 6,296,715 B1. For example, cleaning and rinsing can be performed in the same piece of apparatus in close succession.

The concentration of cleaning chemical in the liquid film from which the bubbles are formed may be assumed to be effectively identical to the concentration of the liquid composition used to create the foam. According to the methods of the present invention, foam compositions that are preferably used to clean the surface of substrates have identical compositions to those available in the liquid phase. Such, foam compositions are effective if they provide sufficient driving forces to remove undesired matter.

In another mechanism, it is thought that the action of the bursting foam bubbles provides the additional necessary force to dislodge undesired matter from the surface of the substrate. The following analysis illustrates the salient features of the bursting bubble model. The work expended to produce one bubble can be expressed as:

$$\text{Work}=A\gamma=4\pi r^2\gamma$$

where A is the total surface area of a bubble and γ is the surface tension of the liquid solution. Assuming that each bubble has a radius of 30 microns, and the surface tension of the foamed solution is 50 dynes/cm, each bubble will discharge 0.0057 ergs upon bursting. A circular wafer, as is typically used in semiconductor manufacture, with a diameter of 30 cm, has a surface area of 707 $cm^2$. Thus, such wafer can accommodate $19.6\times10^6$ bubbles at any given time, assuming uniform complete coverage. If 50% of the bubbles burst, summing the work to produce the bubbles and equating that work to the energy released, results in a total energy imparted to the substrate surface of 55,860 ergs. If it is assumed that the foam is entirely replenished in 1 minute, and that the foam resides on the surface of the substrate for 10 minutes, then 558,600 ergs are imparted to the surface during cleaning.

As a useful indicator of the probable potency of bubble bursting, the force exerted on the surface by a bursting bubble may be compared with the forces exerted during megasonics, another technique used in substrate cleaning processes. Dividing the work to form a single bubble by the radius of the bubble provides the force imparted by a bursting bubble:

$$\text{Force}=4\pi r\gamma$$

Thus, a force value of 1.88 dynes is released from a bursting bubble of radius 30 microns formed from a solution whose surface tension is 50 dynes/cm. The acceleration produced by a bursting foam bubble can be estimated by dividing the force produced by the bursting by the mass of the fluid moving from the burst:

$$\text{Mass}=\pi r^2\delta\rho;\ \text{and}$$

$$\text{Acceleration}=4\gamma/r\delta\rho,$$

wherein $\delta$ is the wall thickness of the bubble, and $\rho$ is the fluid density. Assuming $\delta$=0.001 cm and $\rho$=approximately 1.0 g/cm$^3$, provides an estimated acceleration of $0.66\times10^8$ cm/s$^2$ for an individual bubble.

In megasonics, the ability of the transducer to remove particles from a substrate is measured in terms of the acceleration induced on the liquid medium by sound waves. A 300 W transducer can produce an acceleration of $2.5\times10^8$ cm/sec$^2$, which translates to a dislodging force of $1.25\times10^{-4}$ dynes on a 1 micron particle. Since the acceleration from bubble bursting is the same order of magnitude as the acceleration produced by megasonics, the dislodging force is similar in magnitude and it can be expected that a bursting bubble, or several acting simultaneously, can dislodge particles of 1 micron in size.

Chemical Compositions for Cleaning

There are likely to be at least five general mechanisms for removing impurities from semiconductor wafer surfaces: physical desorption by solvents, a change in the surface charge with either acids or bases, ion complexion by removing metals with chelating agents, oxidation or decomposition of impurities through redox reactions or degradation by free radical attack and etching to release impurities. In general, chemical compositions for cleaning in foam based methods according to the present invention are preferably prepared in liquid form and foamed in contact with a substrate by any of the methods previously described herein.

Fluoride Based Compositions

The fluoride-based compositions of the present invention can change the surface charge of substrates when combined with acids or bases, or etch an oxide surface to release impurities. The cleaning compositions according to this embodiment of the present invention are found in U.S. Pat. Nos. 6,235,693 B1 and 6,248,704 B1, both of which are incorporated herein by reference.

Various papers report the use of dilute HF solutions to clean residues. The ability of these solutions to clean is well known for front end processing, but due to the aggressive nature, HF shows some disadvantages at the interconnect level. Dilute hydrofluoric acid solutions can under certain conditions remove the sidewall polymers by aggressively attacking the via sidewall of the dielectric and therefore changing the dimensions of the device, as taught by Ireland, P., *Thin Solid Films*, 304, pp. 1-12 (1997), and possibly the dielectric constant. Such an attack may result in a loss in critical dimensions, which is not desirable (see Lee, C. and Lee, S., *Solid State Electronics*, 4, pp. 92 1-923 (1997)).

Previous chemistries that contain HF, nitric acid, water and hydroxylamine are aggressive enough to etch silicon, as taught by U.S. Pat. No. 3,592,773 issued to A. Muller. Recent information also indicates that the dilute HF solutions can be ineffective for cleaning the newer $CF_x$ etch residues, as taught by K. Ueno et al., "Cleaning of $CHF_3$ Plasma-Etched SiO2/SiN/Cu Via Structures with Dilute Hydrofluoric Acid Solutions," *J. Electrochem. Soc.*, vol. 144, (7) (1997). In addition, contact holes opened to the TiSi2 layer have also been difficult to clean with HF solutions since there appears to be an attack of the underlying TiSi2 layer.

In a preferred embodiment of the present invention, the fluoride-based compositions suitable for foaming according to the methods of the present invention comprise: from about 0.01 percent by weight to about 10 percent by weight of one or more fluoride compounds; from about 20 percent by weight to about 50 percent by weight water, at least one non-aqueous solvent and is free of both organoammonium and amine carboxylate compounds. The composition preferably has a pH between about 6 and about 10. Additionally, the composition optionally contains corrosion inhibitors, chelating agents, surfactants, acids and bases. The fluoride compound is even more preferably present in an amount from about 0.01 percent by weight to about 5 percent by weight. Preferably the fluoride compound is ammonium fluoride ($NH_4F$), ammonium bifluoride ($NH_4.HF_2$), or hydrogen fluoride (HF). Even more preferably, the fluoride compound is ammonium fluoride or ammonium bifluoride. When the fluoride is HF, the composition is preferably buffered to ensure that the pH is between about 6 and about 10. The water used to formulate the fluoride composition is preferably deionized water. Preferably the non-aqueous solvent is from about 20 percent by weight to about 80 percent by weight of a lactam solvent and optionally from 0 to about 50 weight percent of an organic sulfoxide solvent such as an alkyl sulfoxide, preferably dimethyl sulfoxide, or a glycol solvent such as propylene glycol.

According to this preferred embodiment, suitable lactam solvents include lactams having from 4 to 7 membered rings, including 1 to 5 carbon atom alkyl and alkoxy substituted lactams and 5 to 7 member ring alkane substituted lactams. Suitable specific examples of lactam solvents include piperidones, such as 1 to 5 carbon atom alkyl, dialkyl and alkoxy, dialkoxy piperidones, including N-methyl piperidone, dimethyl piperidone, N-methoxy piperidone, dimethoxy piperidone, N-ethyl piperidone, diethylpiperidone, diethoxy piperidone, and the like; cyclohexyl analogues of these piperidones, such as N-methyl pyrrolidone, N-2(hydroxyethyl-2-pyrrolidone, N-2(cyclohexyl)-2-pyrrolidone, and the like. The preferred lactam solvents are N-methyl piperidone, dimethyl piperidone and N-methyl pyrrolidone. Dimethyl piperidone is commercially available as a mixture of predominantly 1,3 dimethyl piperidone and a minor amount of 1,5 dimethyl piperidone. The lactam solvents can be used either singly or as mixtures.

In an alternative preferred embodiment, the fluoride-based compositions suitable for foaming according to the methods of the present invention comprise: from about 0.01 percent by weight to about 5 percent by weight of one or more fluoride compounds; from about 20 percent by weight to about 50 percent by weight water, at least one non-aqueous solvent and is free of both organoammonium and amine carboxylate compounds. The composition has a pH between about 7 and about 10. Additionally, the composition optionally contains corrosion inhibitors, chelating agents, surfactants, acids and bases. The fluoride compound is even more preferably present in an amount from about 0.05 percent by weight to about 5 percent by weight. Preferably the non-aqueous solvent is from about 20 percent by weight to about 80 percent by weight of an organic amide solvent and from 0 to about 50 weight percent of an organic sulfoxide solvent. Preferably the fluoride compound is ammonium fluoride, ammonium bifluoride, or hydrogen fluoride (HF). Even more preferably, the fluoride compound is ammonium fluoride or ammonium bifluoride. When the fluoride is HF, the composition is preferably buffered to ensure that the pH is between about 7 and about 10. The water used to formulate the fluoride composition is preferably deionized water.

According to this alternative preferred embodiment, suitable organic amide solvents are N,N-dimethylacetamide and N,N-dimethylformamide. The preferred organic amide solvent is N,N-dimethylacetamide. The organic amide solvents can be used either singly or as mixtures. The composition optionally contains alkyl sulfoxides such as dimethyl sulfoxide.

The chelating agents that are optionally included in the fluoride containing foam compositions of the present invention are preferably selected from: catechol, ethylene-diaminetetraacetic acid, citric acid, pentandione and pentandione dioxime. Suitable chelating agents are also described in commonly assigned U.S. Pat. No. 5,672,577, issued Sep. 30, 1997 to Lee, which is incorporated herein by reference.

The acids for use in the fluoride-containing foam compositions preferably include nitric, sulfuric, phosphoric, hydrochloric acids (though hydrochloric acid can be corrosive to metals) and the organic acids, formic, acetic, propionic, n-butyric, isobutyric, benzoic, ascorbic, gluconic, malic, malonic, oxalic, succinic, tartaric, citric, gallic. The last five organic acids are also examples of chelating agents. Concentrations of the acids can vary from about 1 to about 25 wt percent. The important factor is the solubility of the acid and base products in any additional agents in the liquid solutions.

The fluoride-containing compositions of the present invention are free of both organoammonium and amine carboxylate compounds which are phase-transfer catalysts that can accelerate undesirable side reactions such as corrosion and introduce additional cationic and anionic contamination. Nevertheless, it has been found that processing times, can be improved by adding a small amount of an amine, preferably an alkanolamine such as monoethanolamine (MEA), to the chosen formulation. In a preferred embodiment the amine is not a quaternary amine. In an especially preferred embodiment, 0.1 weight percent of MEA is added to a fluoride containing formulation.

In addition, the fluoride cleaning compositions of the present invention are preferably effective at temperatures lower than 100° C. and even more preferably are effective at room temperature. However, some adjustment in reaction temperature may be necessary to allow sufficient foaming, and the reaction temperature of choice will likely rely on the surfactant or surfactants chosen. Moreover, the compositions effective at lower temperatures help to inhibit redeposition of metals, are non-flammable, have low etch rates of silicon dioxide, and are capable of removing post-etch residues from metals, vias, and low-k dielectrics.

The fluoride-based compositions of the present invention avoid the widespread disadvantages of many fluoride-containing compositions that are toxic, and for which conditions must be carefully controlled, and for which evaporation rates are very high, thus requiring further containment procedures.

Hydroxylamine Based Compositions

According to one embodiment of the present invention, alkaline organic solvents for post-etch residue removal can be comprised of amines, alkanolamines, and neutral organic solvents, either alone or in combination. Such formulations are effective at residue removal without causing undesirable damage of the substrate. Where such formulations also require high temperatures, generally over 100° C., they are less preferred, however.

A preferred embodiment of the present invention utilizes a recently-developed class of post-etch residue cleaning chemistries described in U.S. Pat. No. 6,000,411, which is incorporated herein by reference. These foam formulations include hydroxylamine (HDA), an alkanolamine, a surfactant, at least one solvent such as water or a polar solvent, a gas and, optionally, a corrosion inhibitor and/or a chelating agent. The alkanolamine is preferably chosen so as to be miscible with HDA. Such formulations preferably operate at temperatures in the range 70-80° C. and even more preferably operate at lower temperatures. Some adjustment in operating temperature may be desirable to allow sufficient foaming, and the temperature of choice will likely depend on the surfactant or surfactants chosen. Where water is used it is preferably deionized water. Polar solvents can be added to help remove stubborn photoresist material and other impurities without damaging the semiconductor substrate.

Organic derivatives of hydroxylamine, such as $R_1R_2$-hydroxylamine, can also be included, wherein at least one of $R_1$ or $R_2$ must be an alkyl group containing 5 or fewer carbons.

The alkanolamine is preferably selected from the group consisting of monoalkanolamines, dialkanolamines, and trialkanolamines and is present in a concentration that ranges from about 10 to about 80 percent by weight of the formulation.

The chelating agent concentration preferably ranges from about 2.5 to about 30 percent by weight and is selected from the group consisting of:

(1) compounds of formula:

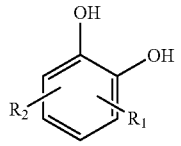

wherein $R_1$ and $R_2$ can be either H, t-butyl, OH, or COOH;

(2) compounds of formula:

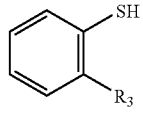

wherein $R_3$ is either OH or COOH; and (3) ethylene diamine tetracarboxylic acid compounds of formula:

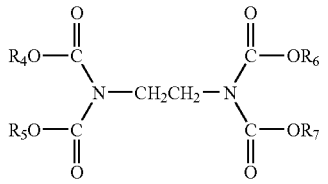

wherein $R_4$, $R_5$, $R_6$ and $R_7$ can independently be either H or $NH_4^+$.

The foam formulation may also additionally comprise an acid that is preferably present in less than about 10% by weight.

Where the at least one solvent of the foam composition includes an organic polar solvent, it preferably a glycol, a glycol alkyl ether, an alkyl N-substituted pyrrolidone, ethylene diamine or ethylene triamine.

Amine Based Formulations ("Copper Compatible Chemistries")

Because of the frequency with which copper finds use in features on the surfaces of substrates, it is preferable for cleaning chemicals to have minimal adverse impact on copper and copper-containing materials. Cleaning chemicals for which this is the case are often referred to as "copper-compatible." A preferred embodiment of the present invention utilizes a recently-developed class of post-etch residue cleaning chemistries described in PCT publication No. WO 00/02238, which is incorporated herein by reference.

Accordingly, formulations for post-etch residue removal preferably comprise an amine, a solvent that may be water or optionally an organic solvent, a gas, a surfactant, and optionally a corrosion inhibitor. The amine is preferably present in about 1 to about 60 weight %. The organic solvent is preferably polar and is present in about 5 to about 80 weight %, preferably from about 20 to about 80% by weight. Water may be present in about 10 to about 80% by weight. The corrosion inhibitor is typically present in about 0.5 to about 5 weight % and preferably from about 1 to about 5 weight %.

The amine is preferably selected from alkaline organic solvents and even more preferably from quaternary ammonium hydroxides such as tetramethylammonium hydroxide (TMAH) and tetrabutylammonium hydroxide (TBAH), quaternary alkanol ammonium hydroxides such as choline ($HO(CH_2)_2N^+(Me)_3$ in solution), choline derivatives such as simple choline salts, and cyclic amine compounds such as morpholine. In an especially preferred embodiment, the amine is choline. It has been found that choline can also be used in combination with hydroxylamine or a hydroxylamine salt, which is preferably present from about 1 to about 12% by weight. In another preferred embodiment, choline is supplemented with a stabilizer selected from the group consisting of: a hydroxylamine salt, hydrazine, a hydrazine salt, and an organic derivative of hydroxylamine with the formula $R_1R_2N$—OH, wherein at least one of $R_1$ or $R_2$ is an alkyl group containing 5 or fewer carbons or Hydrogen.

Polar organic solvents such as N-methyl pyrrolidone (5 member ring), N-methyl piperidone (6 member ring), γ-butylolactone, and propylene glycol are well known to those of skill in the art and can be added alone or in combination with one another to help remove stubborn photoresist material and other impurities without damaging the semiconductor substrate. In particular, these chemicals work well for cleaning copper substrates. However, some reduction in reaction temperature from customary operating temperatures, as described in PCT pub. WO 00/02238, may be desirable to allow sufficient foaming, and the reaction temperature of choice will depend upon the surfactant or surfactants chosen.

Corrosion inhibitors suitable for use in the amine based formulations of the present invention are found at page 8 of PCT publication WO 00/02238 and fall into two broad categories: substituted 5-membered ring heterocycles and hydroxy-substituted benzenes, including hydroxy substituted benzoic acid. Particularly preferred corrosion inhibitors include: catechol, t-butyl catechol, pyrogallol, gallic acid (3,4,5 tri-hydroxy benzoic acid), and benzotriazole.

Other formulations of copper compatible chemistries are shown hereinbelow, in which percentage compositions vary slightly from those described hereinabove. As would be understood by one of skill in the art, a variety of compositions may achieve the desired results.

Application of Foam Techniques to Chemical-Mechanical Polishing

Precision layering of the integrated circuit structure requires that excess materials from the previous manufacturing step be removed from the clean substrate. The CMP process removes the excess material through a wet chemical etch of the surface material followed by a mechanical abrasion of the etched surface. As such, CMP is like a controlled corrosion, and chemical selectivity is essential to maintaining desired intricate features on the substrate. An example is the copper damascene process, where trenches are etched into interdielectric layers, the walls of the trenches are coated with barrier materials, and then copper is deposited into the trench to serve as the conductive material. Excess copper above the trench is then removed by CMP. The challenge in CMP is always to remove the excess material evenly without "dishing," which is the creation of a non-planar surface resulting in poor contact between intervening layers on the substrate. Interlayer dielectrics can be polished in this manner also. A patent that explains CMP is U.S. Pat. No. 6,117,783, which is incorporated herein by reference. The CMP process is performed at ambient pressure, and the pressure applied to the surface of the substrate is slightly above ambient pressure.

It is envisaged that standard CMP apparatus and methodology known to those of skill in the art can be utilized through application of foam-based formulations, resulting in improvements as described herein. However, some adjustment in reaction temperature from temperatures typically practiced in CMP may be necessary to ensure the foam to persist for long enough to be effective. As would be within the discretion of one of ordinary skill in the art, the reaction temperature of choice can be tailored by appropriate choice of surfactant or surfactants. It is not expected that the apparatus shown in FIG. 1 is suitable for CMP. In particular it is envisaged that when using foam in a tank suitable for CMP, no pressurization step is applied.

Periodic Acid Chemistries for CMP

Preferred formulations for use in foam compositions involving periodic acid chemistries are included in U.S. Pat. No. 6,117,783, incorporated herein by reference. In the present invention, periodic acid ($H_5O_6$), an oxidant, is preferably used from 0.1-2.0% in solution with deionized water to serve as an etching agent for CMP. Caustics such as potassium hydroxide, sodium hydroxide, or metal free caustics such as ammonium hydroxide, TMAH, trimethyl(2-hydroxyethyl)ammonium hydroxide (choline), and choline derivatives are added to adjust the pH. A solution comprising periodic acid and, optionally, a caustic, is prepared and caused to foam. Generation of foam from rinsing solutions may utilize the methods of foam generation described hereinabove. The foam is contacted with a substrate during CMP. Where appropriate, a surfactant is added to the formulation in order assist foaming.

Post-cleaning and Post-CMP Processes

Whether cleaning or etching the substrate, the residual chemical and undesired matter is preferably removed in either a post-cleaning or a post-CMP rinse to effectively neutralize residual chemicals and wash away undesired material that may otherwise redeposit. For example, amine-based formulations are capable of removing post-etch residue but are also used in CMP and post-CMP cleaning. However, residual amines are corrosive and can damage the fine structure of the substrate and affect performance. Thus, neutralization of the residual chemical is often necessary to quench further reactions such as corrosion.

Accordingly, the methods of the present invention accommodate the use of foam formulations in rinsing that occurs after either cleaning or etching processes. Generation of foam from rinsing solutions may utilize the methods of foam generation described hereinabove. Preferably foam is introduced and applied to a substrate in a tank.

In a typical rinse, a benign organic chemical such as isopropyl alcohol or N-methylpyrrolidone (NMP) dilutes chemicals from previous process steps, either in liquid or foam form. The substrate is further rinsed with isopropyl alcohol or deionized water, also either in liquid or foam form, and the substrate is then dried with isopropanol vapor. In an alternative embodiment, nitrogen gas can be used to dry the substrate after the rinse. One particular foam formulation useful for removing residual amines is comprised of a monofunctional, difunctional or trifunctional organic acid with a buffering amount of a quaternary amine, ammonium hydroxide, hydroxylamine, hydroxylamine salt, and hydrazine or a hydrazine salt base. Since NMP is not normally used with this formulation, deionized water is typically used for rinsing and a drying step follows.

Preferred formulations for use in foam-based compositions for post-CMP processes, according to the methods of the present invention are found in U.S. Pat. No. 5,981,454, to Small, incorporated herein by reference. In particular, foam-based compositions for post-CMP processes comprise: at least one amine; at least one acid selected from the group consisting of citric acid, formic acid, acetic acid, propionic acid, n-butyric acid, iso-butyric acid, benzoic acid, ascorbic acid, gluconic acid, malic acid, malonic acid, oxalic acid, succinic acid, tartaric acid, and gallic acid; at least one gas selected from the group consisting of nitrogen, argon, helium, air, oxygen, carbon dioxide, and ozone; at least one surfactant suitable to allow foaming selected from the group consisting of anionic surfactants, cationic surfactants, nonionic surfactants, amphoteric surfactants, and silicone based surfactants; at least one chelating agent selected from the group consisting of ethylenediaminetetraacetic acid, citric acid, oximes, lactic acid, 8-hydroxy quinoline, salicylic acid, and salicyclaldoxime; at least one corrosion inhibitor selected from the group consisting of catechol, t-butyl catechol, pyrogallol, gallic acid, benzotriazole; and, deionized water.

An especially preferred foam composition for post-CMP is such that the amine is selected from the group consisting of hydroxylamine, hydroxylamine salts, hydrazine, hydrazine salts, quaternary amines, and ammonium hydroxide. In particular, the concentration of amines is preferably sufficient to buffer the composition to a pH of 4 to 6.

In another preferred foam composition for post-CMP the concentration of acid ranges from about 2.0 to about 11 percent by weight. The preferred concentration of chelating agents is less than or equal to about 1.0 percent by weight and the concentration of surfactants preferably ranges from about 0.05 to about 3.0 percent by weight.

EXAMPLES

Example 1

Fluoride-based Compositions in Cleaning

Liquid phase cleaning of a substrate was compared to foam phase cleaning. The cleaning chemical concentration was the same in both the liquid and foam experiments. Two different proprietary wafers were used in these cleaning experiments. Each wafer surface was contaminated with post-etch residue from the previous removal process. The wafers were designated T and S. Two surfactants were used to make the compositions foamable: a sodium salt of dodecylbenzene sulfonic acid (anionic surfactant, obtained from Aldrich Chemical Co, Milwaukee, Wis.) and NCW601A (nonionic surfactant, obtained from Waco Chemical, Richmond, Va.).

The liquid phase cleaning experiments involved suspending a wafer fragment in a 100 $cm^3$ beaker and stirring the cleaning composition magnetically at room temperature and pressure for a designated time. The foam phase cleaning experiments involved suspending a wafer fragment in a tall cylindrical vessel equipped with a gas dispersion tube for supplying nitrogen gas. Proper adjustment of the gas flow generated a foam head above the liquid phase. The wafer was suspended in the foam head for the designated time.

Table 1 provides a summary of the cleaning compositions and the experimental conditions, wherein designations such as 10/1/10 refer to three times (in minutes): treatment time/rinse time/treatment time. The final rinse was at least two minutes and was followed by drying with nitrogen gas. All experiments were at room temperature.

TABLE 1

Fluoride Cleaning Compositions and Conditions

| Wafer | Phase | Chemical | anionic surfactant wt % | nonionic surfactant wt % | Treatment time (minutes) |
|---|---|---|---|---|---|
| S | LIQUID | | 0.6 | 0.6 | 10/1/10 |
| S | FOAM | | 0.6 | 0.6 | 10/1/10 |
| T | LIQUID | A | 3.0 | | 20 |
| T | FOAM | A | 3.0 | | 20 |
| S | LIQUID | B | | 3.0 | 5/1/5 |
| S | FOAM | B | | 5.0 | 5/1/5 |
| S | FOAM | C | | 0.5 | 10/1/10 |

In order to support a theory that bubble bursting alone provides cleaning power, wafer specimen S had much post-etch residue and was subjected to treatment with a solution of deionized water containing 0.6 weight percent of the anionic surfactant, and 0.18 weight percent of the nonionic surfactant. The treatment cycle comprised 10 minutes of contact with the deionized water and nitrogen bubbles. The wafer was then rinsed for 1 minute, allowed to contact with the deionized water and nitrogen bubbles for another 10 minutes, and then rinsed again for 2 minutes. The wafer was then dried with nitrogen gas. The bursting of the bubbles removed post-etch residue from the wafer surface whereas the same solution of deionized water without nitrogen bubbles showed essentially no cleaning.

In order to support a theory that the chemical in the liquid film surrounding the bubbles would clean at least as well as the same chemical concentration in an all liquid phase solution, wafer samples S and T were cleaned in both liquid and foam phases.

Table 2 provides a rating system for the cleaning and corrosion results, where a score of 0 is the poorest cleaning and the poorest corrosion inhibition, and a score of 10 is the highest level of cleaning and the highest level of corrosion inhibition.

TABLE 2

Experimental Results from Fluoride Based Foam

| Wafer | Phase | Chemical | anionic surfactant wt % | nonionic surfactant wt % | Cleaning Rating | Corrosion Rating |
|---|---|---|---|---|---|---|
| T | LIQUID | A | 3 | | 9 | 10 |
| T | LIQUID | A | 3 | | 9 | 10 |
| T | FOAM | A | 3 | | 9 | 10 |
| T | FOAM | A | 3 | | 9 | 10 |
| S | LIQUID | DI | 0.6 | 0.6 | 6 | 10 |
| S | LIQUID | DI | 0.6 | 0.6 | 7 | 10 |
| S | FOAM | DI | 0.6 | 0.6 | 8 | 10 |
| S | FOAM | DI | 0.6 | 0.6 | 8.5 | 9 |
| S | LIQUID | A | 3 | | 8.5 | 10 |
| S | LIQUID | A | 3 | | 9 | 10 |
| S | FOAM | A | 3 | | 9 | 9 |
| S | FOAM | A | 3 | | 9 | 9 |

TABLE 2-continued

Experimental Results from Fluoride Based Foam

| Wafer | Phase | Chemical | anionic surfactant wt % | nonionic surfactant wt % | Cleaning Rating | Corrosion Rating |
|---|---|---|---|---|---|---|
| S | LIQUID | B | | 3 | 9 | 10 |
| S | LIQUID | B | | 3 | 8 | 10 |
| S | FOAM | B | | 5 | 8 | 10 |
| S | FOAM | B | | 5 | 8 | 10 |
| S | LIQUID | B | | 3 | 8 | 10 |
| S | LIQUID | B | | 3 | 8.5 | 10 |
| S | LIQUID | B | | 1.5 | 8 | 10 |
| S | LIQUID | B | | 1.5 | 5 | 10 |
| S | FOAM | C | | 0.5 | 7 | 10 |
| S | FOAM | C | | 0.5 | 9 | 10 |
| S | FOAM | C | | 0.5 | 9 | 10 |
| S | FOAM | C | | 0.5 | 9 | 10 |

Formulations A, B, and C are designations for EKC formulations EKC 640, EKC 640D, and EKC 6800 respectively. All EKC chemicals are available from EKC Technologies, 2520 Barrington Ct., Hayward, CA 94545. These formulations are representative of the examples in U.S. Pat. Nos. 6,248,704 B1 and 6,235,693 B1. DI is deionized water.

Figure 8:
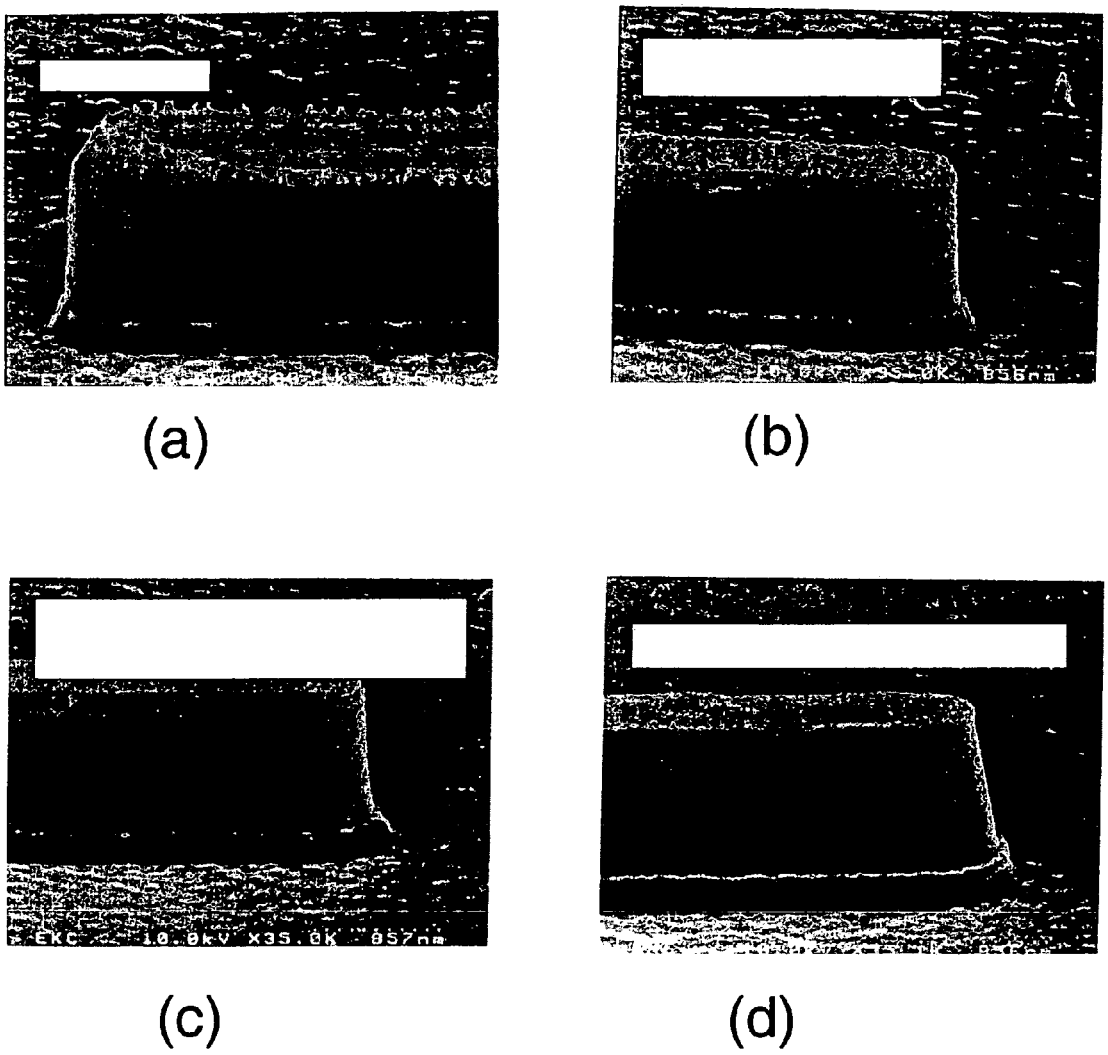
FIG. 8 is a set of SEM images that illustrate the numerical range of values in the cleaning and corrosion rating scale.

FIG. 8 shows a set of SEM images of a "metal line" wafer comprising a TiN layer on top of an Al layer, itself on top of another TiN layer that is in contact with the substrate. The SEM images illustrate the numerical range of values in the cleaning and corrosion rating scale. FIG. 8A shows the wafer with PER that has not been cleaned. The cleaning rating is 0 and the corrosion inhibition rating does not apply without treatment. FIG. 8B shows the wafer with a cleaning rating of 5 and a corrosion rating of 10. FIG. 8C shows the wafer with a cleaning rating of 8 and a corrosion rating of 10. FIG. 8D shows the wafer with a cleaning rating of 9 and a corrosion rating of 10.

Example 2

Hydroxylamine Based Compositions

Table 3 provides examples chemical formulations capable of foaming with surfactants with each component expressed in weight percent prior to addition of surfactant.

TABLE 3

Some HDA Cleaning Formulations Capable of Foaming

| Formula | Hydroxylamine wt % | Diglycol amine wt % | DI wt % | 2-methylamine ethanol (MAE) wt % | Catechol wt % | Gallic Acid wt % |
|---|---|---|---|---|---|---|
| D | 35 | 60 | | | 5 | |
| E | 30 | 55 | 5 | | | 10 |
| F | 30 | 27.5 | 5 | 27.5 | | 10 |
| G | 26 | 48 | 17.5 | | | 8.5 |

Formulations D, E, F and G additionally contain an amount of a surfactant sufficient to ensure foaming at desired operating temperatures.

Example 3

Copper-compatible Chemistries

Some copper compatible cleaning formulations that are capable of foaming, along with variations in those formulations are provided in the Tables 4 and 5.

TABLE 4

Some Copper Compatible Cleaning Formulations for Use in Foaming-based Cleaning

| Formula | Composition/Weight % | Temp (C.) | Time (min) |
|---|---|---|---|
| H | 40-60% morpholine, 20-50% N-methyl pyrrolidone, 5-25% γ-butylolactone | 45-85 | 5-60 |
| I | 5-45% choline, 1-10% hydroxylamine, 60-90% deionized water | 35-85 | 5-60 |

TABLE 4-continued

Some Copper Compatible Cleaning Formulations for Use in Foaming-based Cleaning

| Formula | Composition/Weight % | Temp (C.) | Time (min) |
|---|---|---|---|
| J | 1-10% 2-methylamine ethanol, 20-50% N-methyl pyrrolidone, 50-90% dimethyl sulfoxide | 45-105 | 5-60 |
| K | 10-50% choline, 20-80% propylene glycol, ~25% deionized water. | 35-85 | 5-60 |

It is noted that formulations H and J in Table 4 do not have deionized water in them. All of formulations H through J additionally contain an amount of a surfactant sufficient to ensure foaming.

TABLE 5

Other Copper Compatible Cleaning Formulations for Use in Foaming Technologies.

TABLE 5A

| H | Weight % | EXISTING | OTHERS |
|---|---|---|---|
| amine | 40-60 | morpholine | monoethanolamine, diglycol amine, di(ethylene) triamine, tri(ethylene) tetramine, 2-methylamine ethanol, choline hydroxide, bis(2-hydroxyethyl) dimethylammonium hydroxide, and tris(2-hydroxyethyl) dimethylammonium hydroxide |
| polar solvent 1 | 20-50 | N-methyl pyrrolidone | N-(2-hydroxyethyl)-2-pyrrolidone, dimethyl sulfoxide, di(methyl) formamide, and di(methyl) acetamide |
| polar solvent 2 | 5-25 | γ-butylolactone | ethylene carbonate, propylene carbonate, di(propyleneglycol) monomethyl ether, ethyl lactate, propyl lactate, butyl lactate, and propylene glycol |
| corrosion inhibitor | 0-5 | n/a | catechol, t-butyl catechol, pyrogallol, gallic acid, and benzotriazole |

TABLE 5B

| I | Weight % | EXISTING | OTHERS |
|---|---|---|---|
| amine | 20-50 | choline hydroxide | bis(2-hydroxyethyl) dimethylammonium hydroxide, tris(2-hydroxyethyl) dimethylammonium hydroxide, choline bicarbonate, monoethanolamine, diglycol amine, di(ethylene) triamine, and tri(ethylene) tetramine |
| hydroxylamine | 1-10 | HDA | HDA salts, hydrazine, hydrazine salts, di(ethyl) HDA, and propyl HDA |
| Solvent | 60-90 | $H_2O$ | |
| corrosion inhibitor | 0-5 | n/a | catechol, t-butyl catechol, pyrogallol, gallic acid, and benzotriazole |

TABLE 5C

| J | Weight % | EXISTING | OTHERS |
|---|---|---|---|
| amine | 1-10 | 2-methylamine ethanol | monoethanolamine, diglycol amine, di(ethylene) triamine, tri(ethylene) tetramine, choline hydroxide, and bis(2-hydroxyethyl) dimethylammonium hydroxide, and tris(2-hydroxyethyl) dimethylammonium hydroxide |
| polar solvent 1 | 20-50 | N-methyl pyrrolidone | dimethyl sulfoxide, N-(2-hydroxyethyl)-2-pyrrolidone, di(methyl) formamide, and di(methyl) acetamide |
| polar solvent 2 | 20-50 | dimethyl sulfoxide | N-methyl pyrrolidone, N-(2-hydroxyethyl)-2-pyrrolidone, di(methyl) formamide, and di(methyl) acetamide |
| corrosion inhibitor | 0-5 | n/a | catechol, t-butyl catechol, pyrogallol, gallic acid, and benzotriazole |

TABLE 5-continued

Other Copper Compatible Cleaning Formulations for Use in Foaming Technologies.

TABLE 5D

| K | Weight % | EXISTING | OTHERS |
|---|---|---|---|
| amine | 10-50 | choline hydroxide | bis(2-hydroxyethyl) dimethylammonium hydroxide, tris(2-hydroxyethyl) dimethylammonium hydroxide, monoethanolamine, diglycol amine, di(ethylene) triamine, tri(ethylene) tetramine, and choline bicarbonate. |
| Polar solvent | 20-80 | propylene glycol | γ-butylolactone, ethylene carbonate, propylene carbonate, di(propyleneglycol) monomethyl ether, ethyl lactate, propyl lactate, and butyl lactate. |
| Solvent | ~25 | $H_2O$ | |
| corrosion inhibitor | 0-5 | n/a | catechol, t-butyl catechol, pyrogallol, gallic acid, and benzotriazole |

In Tables 5A-D, alternative compositions for formulations H, I, J and K, respectively, are indicated. In the right hand column of each row, headed "others", alternative materials are listed that could replace the component of the formulation indicated by the row in question.

Example 4

Periodic Acid

The following example is from U.S. Pat. No. 6,117,783 and shows the effect of pH when using periodic acid. Removal rates of tungsten generally increase with pH for periodic acid in water on 3" wafers coated with sputtered tungsten using 1% or 2.5% alumina and 0-3 parts ammonium hydroxide to adjust pH. Periodic acid was added to an alumina slurry at a rate of 50-100 mL/min, and the wafers were polished using a Logitech PM5 polisher (33 rpm, 12" IC1000 pad, 2 psig):

TABLE 6

Effect of pH on Etching with Periodic Acid

| Alumina (parts per 100) | Periodic Acid (parts per 100) | pH | Removal Rate (Angstrom/min) |
|---|---|---|---|
| 1.0 | 2.0 | 1.4 | 130 |
| 1.0 | 2.0 | 1.9 | 274 |
| 1.0 | 2.0 | 2.1 | 326 |

TABLE 6-continued

Effect of pH on Etching with Periodic Acid

| Alumina (parts per 100) | Periodic Acid (parts per 100) | pH | Removal Rate (Angstrom/min) |
|---|---|---|---|
| 2.5 | 2.0 | 2.1 | 252 |
| 2.5 | 2.0 | 6.8 | 426 |

Table 6 shows that periodic acid is an effective etchant, and that the etch rate can be controlled by adjusting the pH of the periodic acid and alumina slurry using inorganic bases such as KOH and NaOH, or metal-free organic bases such as TMAH, choline, and choline derivatives. For use in foam compositions, a surfactant is added to the periodic acid formulation.

Example 5

Post-cleaning Rinse

The preferred compositions are found in U.S. Pat. No. 5,981,454 which is hereby incorporated by reference. The economy and cleaning power of these formulations is also improved through addition of the proper surfactant to enable foaming. Exemplary formulations for use in foam compositions are shown in Table 7, where it is assumed that additional amounts of surfactant are added to ensure efficient production of foam.

TABLE 7

Post-cleaning and Post CMP Rinse Formulations for Use with Foam-based Technologies.

| L | Weight PERCENT | EXISTING | OTHERS |
|---|---|---|---|
| hydroxylamine (HDA) | see below | HDA | HDA salts, hydrazine, hydrazine salts, quaternary amine, and ammonium hydroxide |
| $H_2O$ | remainder | $H_2O$ | |
| acid | 2-11 | citric | formic, acetic, propionic, n-butyric, iso-butyric, benzole, ascorbic, gluconic, malic, malonic, oxalic, succinic, tartaric, and gallic acids. |
| chelator | 0-1 | n/a | ethylenediamine tetraacetic acid, citric acid, oximes, lactic acid, 8-hydroxy quinoline, salicylic acid, and salicyclaldoxime. |

In Table 7, the reaction temperature is from about room temperature to about 30° C., and reaction time is from about 1-15 minutes. The percentage composition of HDA is an amount sufficient to buffer the solution to pH 4-6.

All publications and patent applications mentioned in this specification are herein incorporated by reference to the same extent as if each individual publication or patent application was specifically and individually indicated to be incorporated by reference.

One skilled in the art will recognize from the foregoing examples that modifications and variations can, and are expected to be made, to the foregoing foam compositions in accordance with varying conditions inherent in the production process, without departing from the spirit or scope of the appended claims. The embodiments above are given by way of example and do not limit the present invention, which is defined by the following claims.

What is claimed is:

1. A method for treating a semiconductor wafer having a surface to which undesired matter adheres comprising:

a) placing said semiconductor wafer having a surface within a treatment vessel;

b) contacting said surface with a foam forming composition comprising:

at least one fluoride compound that is free of both organoammonium and amine carboxylate compounds;

between 20% and 80% by weight of at least one organic polar solvent;

at least one surfactant in an amount sufficient to form foam; and water, and at least one alkanolamine; and c) introducing at least one gas through said foam forming composition to form foam, wherein said gas is introduced through an inlet submerged in the foam forming composition.

2. The method of claim 1 wherein said at least one surfactant is selected from the group consisting of cationic surfactants and nonionic surfactants.

3. The method of claim 1 wherein the fluoride compound is selected from the group consisting of ammonium fluoride, ammonium bifluoride or hydrogen fluoride.

4. The method of claim 1 wherein said foam forming composition additionally comprises a corrosion inhibitor selected from the group consisting of catechol, t-butyl catechol, pyrogallol, gallic acid and benzotriazole.

5. The method of claim 1 wherein said foam forming composition additionally comprises a chelating agent.

6. The method of claim 1 wherein said at least one solvent is an organic amide solvent wherein the organic amide solvent concentration range from about 20 percent to about 80 percent by weight.

7. The method of claim 6 wherein said foam forming composition additionally comprises up to about 50 weight percent of a sulfoxide solvent.

8. The method of claim 6 wherein the organic amide solvent comprises an alkylamide.

9. The method of claim 1 wherein the organic solvent is a lactam.

10. The method of claim 1 wherein the organic solvent is selected from the group consisting of: a 5-member ring lactam substituted with an alkyl group, a 6-member ring lactam substituted with an alkyl group, a 7-member ring lactam substituted with an alkyl group, a piperidone substituted with an alkyl group, and a piperidone substituted with an alkoxy group, wherein any of said alkyl groups and alkoxy groups comprises from 1 to 5 carbon atoms.

11. The method of claim 10 wherein the organic solvent is a piperidone selected from the group consisting of dialkyl, and dialkoxy-substituted piperidones.

12. The method of claim 10 wherein the organic solvent is selected from the group consisting of N-methyl piperidone, dimethyl piperidone, N-ethyl piperidone, diethylpiperidone, N-methoxy piperidone, dimethoxy piperidone and diethoxy piperidone.

13. A method for treating a semiconductor wafer having a surface to which undesired matter adheres comprising:

a) placing said semiconductor wafer having a surface within a treatment vessel;

b) contacting said surface with a foam forming composition comprising:

at least one hydroxylamine; wherein the hydroxylamine concentration ranges from about 5 to about 50 percent by weight at least one alkanolamine; wherein the at least one alkanolamine concentration ranges from about 10 to about 80 percent by weight at least one surfactant; and, at least one organic polar solvent and c) introducing at least one gas through said foam forming composition to form foam, wherein said gas is introduced through an inlet submerged in the foam forming composition.

14. The method of claim 13 wherein said at least one surfactant is selected from the group consisting of anionic surfactants, cationic surfactants, nonionic surfactants, amphoteric surfactants, and silicone based surfactants.

15. The method of claim 13 wherein said foam forming composition additionally comprises a chelating agent.

16. The method of claim 15 wherein the chelating agent concentration ranges from about 2.5 to about 30 percent by weight.

17. The method of claim 13 wherein said foam forming composition additionally comprises an acid.

18. The method of claim 13 wherein the organic polar solvent is a glycol, a glycol alkyl ether, an alkyl N-substituted pyrrolidone, ethylene diamine or ethylene triamine.

19. A method for treating a semiconductor wafer having a surface to which undesired matter adheres comprising:

a) placing said semiconductor wafer having a surface within a treatment vessel;

b) contacting said surface with a foam forming composition comprising: at least one amine; at least one solvent; at least one surfactant in an amount sufficient to form foam, and hydroxylamine in a concentration that ranges from about 1 to about 10 percent by weight; and c) introducing at least one gas through said foam forming composition to form foam, wherein said gas is introduced through an inlet submerged in the foam forming composition.

20. The method of claim 19 wherein the at least one amine is selected from the group consisting of morpholine, 2-methylamine ethanol, choline, and a choline derivative.

21. The method of claim 19 wherein the at least one amine is morpholine at concentration ranges from about 40 to about 60 percent by weight.

22. The method of claim 19 wherein the at least one amine is 2-methylamine ethanol at concentration ranges from about 1 to about 10 percent by weight.

23. The method of claim 19 wherein the at least one amine is choline hydroxide and its concentration ranges from about 10 to about 50 percent by weight.

24. The method of claim 19 wherein the at least one amine is selected from the group consisting of monoethanolamine, diglycol amine, di(ethylene triamine), tri(ethylene) tetramine, 2-methylamine ethanol, choline hydroxide, bis(2-hydroxyethyl) dimethyl-ammonium hydroxide, tris(2-hydroxyethyl)dimethylanimonium hydroxide, and choline bicarbonate.

25. The method of claim 19 wherein the solvent comprises at least one solvent selected from the group consisting of N-(2-hydroxyethyl)-2-pyrrolidone, di(methyl) formamide, di(methyl) acetamide, ethylene carbonate, propylene carbonate, di(propylene glycol) monomethyl ether, ethyl lactate, propyl lactate, butyl lactate, and propylene glycol.

26. The method of claim 19 wherein said foam forming composition additionally comprises a corrosion inhibitor selected from the group consisting of catechol, t-butyl catechol, pyrogallol, gallic acid and benzotriaole.

27. The method of claim 19 wherein the solvent comprises N-methyl pyrrolidone at concentration ranges from about 20 to about 50 percent by weight.

28. The method of claim 19 wherein the solvent comprises y-butylolactone at concentration ranges from about 5 to about 25 percent by weight.

29. The method of claim 19 wherein the solvent comprises dimethyl sulfoxide at concentration ranges from about 20 to about 50 percent by weight.

30. The method of claim 19 wherein the solvent comprises propylene glycol at concentration ranges from about 20 to about 80 percent by weight.

* * * * *